US007654654B2

(12) United States Patent
Ito et al.

(10) Patent No.: US 7,654,654 B2
(45) Date of Patent: Feb. 2, 2010

(54) INK JET PRINTER HEAD

(75) Inventors: Atsushi Ito, Nagoya (JP); Koji Imai, Inuyama (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 520 days.

(21) Appl. No.: 11/727,999

(22) Filed: Mar. 28, 2007

(65) Prior Publication Data

US 2007/0236544 A1 Oct. 11, 2007

Related U.S. Application Data

(62) Division of application No. 10/943,395, filed on Sep. 17, 2004, now Pat. No. 7,213,912.

(30) Foreign Application Priority Data

Sep. 19, 2003 (JP) ..... 2003-328349
Mar. 15, 2004 (JP) ..... 2004-072357

(51) Int. Cl.
*B41J 2/045* (2006.01)

(52) U.S. Cl. ..... 347/72

(58) Field of Classification Search ..... 347/72
See application file for complete search history.

(56) References Cited

U.S. PATENT DOCUMENTS 6,604,817 B2 8/2003 Isono et al.
6,631,981 B2 10/2003 Isono et al.
2001/0020968 A1 9/2001 Isono et al.
2002/0003560 A1 1/2002 Isono et al.
2003/0067510 A1 8/2003 Isono et al.

FOREIGN PATENT DOCUMENTS

JP 10202876 8/1998
JP 2001-260349 9/2001
JP 2002-19102 1/2002
JP 2002-36544 2/2002

*Primary Examiner*—Matthew Luu
*Assistant Examiner*—Lisa M Solomon
(74) *Attorney, Agent, or Firm*—Reed Smith LLP

(57) ABSTRACT

An ink jet printer head including a cavity unit; an piezoelectric actuator; and a wiring substrate. The piezoelectric actuator includes pairs of first common electrode connection pads and pairs of first individual electrode connection pads which are provided on an outer surface thereof such that the two first common electrode connection pads of each of the pairs are located at respective positions symmetric with each other with respect to a first reference point on the outer surface and the two first individual electrode connection pads of each of the pairs are located at respective positions symmetric with each other with respect to the first reference point. The wiring substrate further includes a second common electrode connection pad and a plurality of second individual electrode connection pads which are provided at respective positions assuring that when the wiring substrate takes a first angular phase about a second reference point corresponding to the first reference point, and when the wiring substrate takes a second angular phase differing from the first angular phase by 180 degrees about the second reference point, the second common electrode connection pad is electrically connected to at least one of the first common electrode connection pads and the second individual electrode connection pads are electrically connected to the first individual electrode connection pads, respectively.

8 Claims, 23 Drawing Sheets

1a
H1
X
89
30
23-1
28
12
40
50
50c
50b
50a
23-2
28
30
C
22
21
20
19
18
17
16
15
11
10
27
29
26
11a-1
11a-2
25
27
29
26

28a
28
28b

INK JET PRINTER HEAD

This is a divisional application of the application Ser. No. 10/943,395 filed on Sep. 17, 2004 now U.S. Pat. No. 7,213,912, which claims priority to Japanese Patent Application No. 2003-328349 filed on Sep. 19, 2003 and Japanese Patent Application No. 2004-72357 filed on Mar. 15, 2004, the contents of which are incorporated herein by reference.

BACKGROUND OF THE INVENTION

1. Field of the Invention

The present invention relates to an ink jet printer head and particularly to such an ink jet printer head which employs a piezoelectric actuator and has a plurality of ink ejection nozzles and which ejects, from an arbitrary one of the ink ejection nozzles, a droplet of ink by driving or operating the piezoelectric actuator.

2. Discussion of Related Art

Japanese Patent Application Publication No. 2002-36544, Japanese Patent Application Publication No. 2002-19102, or their corresponding U.S. Pat. No. 6,631,981 discloses an on-demand-type ink jet printer head. The disclosed printer head employs a cavity unit which is constituted by a plurality of sheet members stacked on each other and has a plurality of ink channels. Those sheet members include a nozzle sheet having a plurality of ink ejection nozzles; a base sheet having a plurality of pressure chambers communicating with the ink ejection nozzles, respectively; and a manifold sheet having a manifold chamber as a common ink chamber that communicates, at its inlet end, with an ink supply source and, at its outlet ends, with the pressure chambers. The disclosed printer head additionally employs a piezoelectric actuator including a plurality of piezoelectric sheets and a plurality of internal electrodes that are alternately stacked on each other. The plurality of internal electrodes include a plurality of common electrodes and a plurality of individual-electrode layers that are alternate with each other in the direction of stacking of the piezoelectric sheets and the internal electrodes. Each of the individual-electrode layers includes a plurality of individual electrodes that are independent of each other. Thus, the piezoelectric actuator includes a plurality of active portions each of which includes respective one individual electrodes of the individual-electrode layers, respective portions of the common electrodes that are aligned with those respective individual electrodes in the stacking direction, and respective portions of the piezoelectric sheets that are aligned with those respective individual electrodes in the same direction. The piezoelectric actuator is bonded to the cavity unit, such that each of the active portions of the piezoelectric actuator is aligned, in its plan view, with a corresponding one of the pressure chambers of the cavity unit.

The piezoelectric actuator has, on an outer surface of an outermost sheet thereof, a plurality of external individual electrodes that are electrically connected to the internal individual electrodes of each one of the individual-electrode layers, respectively, via a plurality of internal conductive leads extending through a corresponding one of the piezoelectric sheets in the stacking direction; and an external common electrode that is electrically connected to each one of the common electrodes via an internal conductive lead extending through a corresponding one of the piezoelectric sheets in the stacking direction. Each one of the external individual electrodes, and the external common electrode are used to apply an electric voltage to a corresponding one of the active portions of the piezoelectric actuator. To this end, the external individual and common electrodes of the piezoelectric actuator are bonded to respective connection electrodes of a flexible flat cable which transmits control signals supplied from an external device.

In the disclosed printer head, however, the external individual and common electrodes are located, on the outer surface of the piezoelectric actuator, along opposite end portions of the outer surface that extend in a lengthwise direction thereof, i.e., in a direction in which the ink ejection nozzles are arranged in one or more arrays. Consequently a great number of lead wires which are connected, at respective one ends thereof, to the connection electrodes and are connected, at respective other ends thereof, to an external driver IC (integrated circuit) are formed in narrow portions of the flexible flat cable that correspond to the above-indicated opposite end portions of the outer surface of the piezoelectric actuator. Therefore, as a total number of the ink ejection nozzles or the active portions increases, a distance between each pair of lead wires located adjacent each other decreases, and accordingly a mutual inductance produced between the each pair of adjacent lead wires increases. This leads to lowering a printing performance of the printer head.

In this background, Japanese Patent Application Publication No. 2001-260349 or its corresponding U.S. Pat. No. 6,604,817 has proposed to prevent the increasing of the above-indicated mutual inductance by connecting the flexible flat cable to the outer surface of the piezoelectric actuator, such that the flat cable extends in a direction perpendicular to the lengthwise direction of the outer surface, and form the thin lead wires such that the lead wires are distant from each other in the direction in which the arrays of ink ejection nozzles extend.

SUMMARY OF THE INVENTION

The above-indicated cavity unit and piezoelectric actuator are bonded to each other, and thus a printer head is prepared in advance. One end of the above-indicated flexible flat cable is bonded to this printer head, and the thus obtained printer head is fixed to a lower surface of a carriage on which, e.g., an ink cartridge is mounted. The other end of the flexible flat cable is connected to a main control portion of the ink jet printer that outputs printing commands. Which one of the two long sides of the printer head the flexible flat cable is extended from depends on the design of the ink jet printer. However, if the pattern of the external electrodes provided on the outer surface of the outermost sheet of the piezoelectric actuator needs to be changed depending upon which one of the two long sides of the nozzle head the flat cable is extended from, then the cost of production of the printer head increases.

The external electrodes of the piezoelectric actuator and the connection electrodes of the flexible flat cable are bonded to each other, as follows: First, the connection electrodes of the flat cable are placed on the external electrodes of the actuator, respectively, and, in this state, those electrodes are heated so as to melt an electrically conductive material, such as solder, that is adhered, in advance, to either the connection electrodes or the external electrodes. The piezoelectric actuator is formed of a ceramic material, whereas the flexible flat cable is formed of an electrically insulating synthetic resin material such as polyimide. The ceramic and resin materials have different coefficients of linear expansion. Therefore, when the connection electrodes and the external electrodes, bonded to each other by heating, are cooled down to room temperature, the flat cable shrinks and accordingly stresses concentrate on the soldered or bonded portions, so that the bonded portions may rupture. In addition, the bonded portions may rupture because the flat cable expands and shrinks due to the changes of environmental temperature.

It is therefore an object of the present invention to provide an ink jet printer head which is free from at least one of the above-identified problems. It is another object of the present invention to provide an ink jet printer head which has, on an outer surface of an outermost sheet of a piezoelectric actuator thereof, external individual and common electrodes provided in such a pattern assuring that a direction in which a cable member, such as a flexible flat cable, is bonded to the outermost sheet of the piezoelectric actuator can be changed by 180 degrees, and which additionally assures that the ink jet printer head can be produced at low cost. It is another object of the present invention to provide an ink jet printer head which prevents, even though temperature may change, the rupture of bonded portions where external electrodes of a piezoelectric actuator and connection electrodes of a cable member are bonded to each other, and which enjoys a high reliability. Each of these objects may be achieved according to the present invention.

According to a first aspect of the present invention, there is provided an ink jet printer head comprising a cavity unit including a plurality of ink ejection nozzles, and a plurality of pressure chambers communicating with the ink ejection nozzles, respectively; and a piezoelectric actuator including a plurality of active portions each of which is driven to change a pressure of an ink accommodated in a corresponding one of the pressure chambers, and thereby eject, from a corresponding one of the ink ejection nozzles, a droplet of the ink, the piezoelectric actuator including at least one common electrode common to the active portions, and a plurality of individual electrodes corresponding to the active portions, respectively. The cavity unit and the piezoelectric actuator are fixed to each other. The ink jet printer head further comprises a wiring substrate having at least one common wiring, and a plurality of individual wirings each of which cooperates with the at least one common wiring to apply an electric voltage to a corresponding one of the active portions. The piezoelectric actuator further includes a plurality of pairs of first common electrode connection pads and a plurality of pairs of first individual electrode connection pads which are provided on an outer surface thereof such that the two first common electrode connection pads of each of the pairs are located at respective positions symmetric with each other with respect to a first reference point on the outer surface and the two first individual electrode connection pads of each of the pairs are located at respective positions symmetric with each other with respect to the first reference point, and such that the first common electrode connection pads are electrically connected to the at least one common electrode and the first individual electrode connection pads are electrically connected to the individual electrodes, respectively. The wiring substrate further includes at least one second common electrode connection pad connected to the common wiring, and a plurality of second individual electrode connection pads which are connected to the individual wirings, respectively, and are provided at respective positions assuring that when the wiring substrate takes a first angular phase about a second reference point corresponding to the first reference point, the at least one second common electrode connection pad is electrically connected to at least one of the first common electrode connection pads and the second individual electrode connection pads are electrically connected to the first individual electrode connection pads, respectively, and when the wiring substrate takes a second angular phase differing from the first angular phase by 180 degrees about the second reference point, the at least one second common electrode connection pad is electrically connected to at least one of the first common electrode connection pads and the second individual electrode connection pads are electrically connected to the first individual electrode connection pads, respectively.

In the ink jet printer head in accordance with the first aspect of the present invention, the first common electrode connection pads and the first individual electrode connection pads are provided on the outer surface of the piezoelectric actuator, such that the two first common electrode connection pads of each of the pairs are located at the respective positions symmetric with each other with respect to the first reference point (e.g., a center) of the outer surface of the piezoelectric actuator, and the two first individual electrode connection pads of each of the pairs are located at the respective positions symmetric with each other with respect to the first reference point, and the second common electrode connection pad and the second individual electrode connection pads are provided, on the wiring substrate, at the respective positions assuring that when the wiring substrate takes the first angular phase about the second reference point corresponding to the first reference point, relative to the piezoelectric actuator, the second common electrode connection pad is electrically connected to at least one of the first common electrode connection pads, and the second individual electrode connection pads are electrically connected to the first individual electrode connection pads, respectively, and when the wiring substrate takes the second angular phase differing from the first angular phase by 180 degrees about the second reference point, the second common electrode connection pad is electrically connected to at least one of the first common electrode connection pads and the second individual electrode connection pads are electrically connected to the first individual electrode connection pads, respectively. Therefore, two identical wiring substrates can be easily connected to two identical printer heads, from two opposite directions, respectively, that differ from each other by 180 degrees.

According to a second aspect of the present invention, there is provided an ink jet printer head comprising a cavity unit including a plurality of ink ejection nozzles arranged in at least one array in a first direction, and a plurality of pressure chambers arranged in at least one array in the first direction and communicating with the ink ejection nozzles, respectively; and a piezoelectric actuator including a plurality of active portions each of which is driven to change a pressure of an ink accommodated in a corresponding one of the pressure chambers, and thereby eject, from a corresponding one of the ink ejection nozzles, a droplet of the ink. The piezoelectric actuator additionally includes, on an outer surface thereof, a plurality of first individual electrode connection pads arranged in at least one array in the first direction and corresponding to the active portions, respectively. The ink jet printer head further comprises a wiring substrate including at least one common wiring, a plurality of individual wirings each of which cooperates with the at least one common wiring to apply an electric voltage to a corresponding one of the active portions of the piezoelectric actuator, and a plurality of second individual electrode connection pads connected to the individual wirings, respectively, arranged in at least one array, and corresponding to the first individual electrode connection pads, respectively. The piezoelectric actuator further includes, on the outer surface thereof, a plurality of first redundant connection pads including at least one first common electrode connection pad common to the active portions, and at least one first group of redundant connection pads arranged along the at least one array of first individual electrode connection pads. The wiring substrate further includes a plurality of second redundant connection pads including at least one second common electrode connection pad connected to the at least one common wiring, and at least one second group of redundant connection pads arranged along the at least one array of second individual electrode connection pads. The wiring substrate is provided on the outer surface of the piezoelectric actuator, such that the second individual electrode connection pads are electrically connected to the first individual electrode connection pads, respectively, the at least one second common electrode connection pad is electrically connected to the at least one first common electrode connection pad, and the redundant connection pads of the at least one second group are connected to the redundant connection pads of the at least one first group, respectively. The at least one first group of redundant connection pads may, or may not, comprise the at least one first common electrode connection pad, and the at least one second group of redundant connection pads may, or may not, comprise the at least one second common electrode connection pad.

In the ink jet printer head in accordance with the second aspect of the present invention, the first redundant connection pads of the piezoelectric actuator are connected to the second redundant connection pads of the wiring substrate, respectively, when the respective arrays of the first and second individual electrode connection pads are connected to each other. Since the first redundant connection pads are arranged along the array of first individual electrode connection pads and the second redundant connection pads are arranged along the array of second individual electrode connection pads, the first redundant connection pads and the second redundant connection pads, connected to each other, effectively prevent stresses caused by the expansion and shrinkage of the piezoelectric actuator and the wiring substrate because of their temperature changes, from concentrating on respective bonded portions of the first individual electrode connection pads and the second individual electrode connection pads, and thereby prevent the latter bonded portions from breaking and accordingly effectively prevent the ink jet printer head from falling into malfunction. Thus, the ink jet printer head can enjoy high reliability.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

Figure 1:
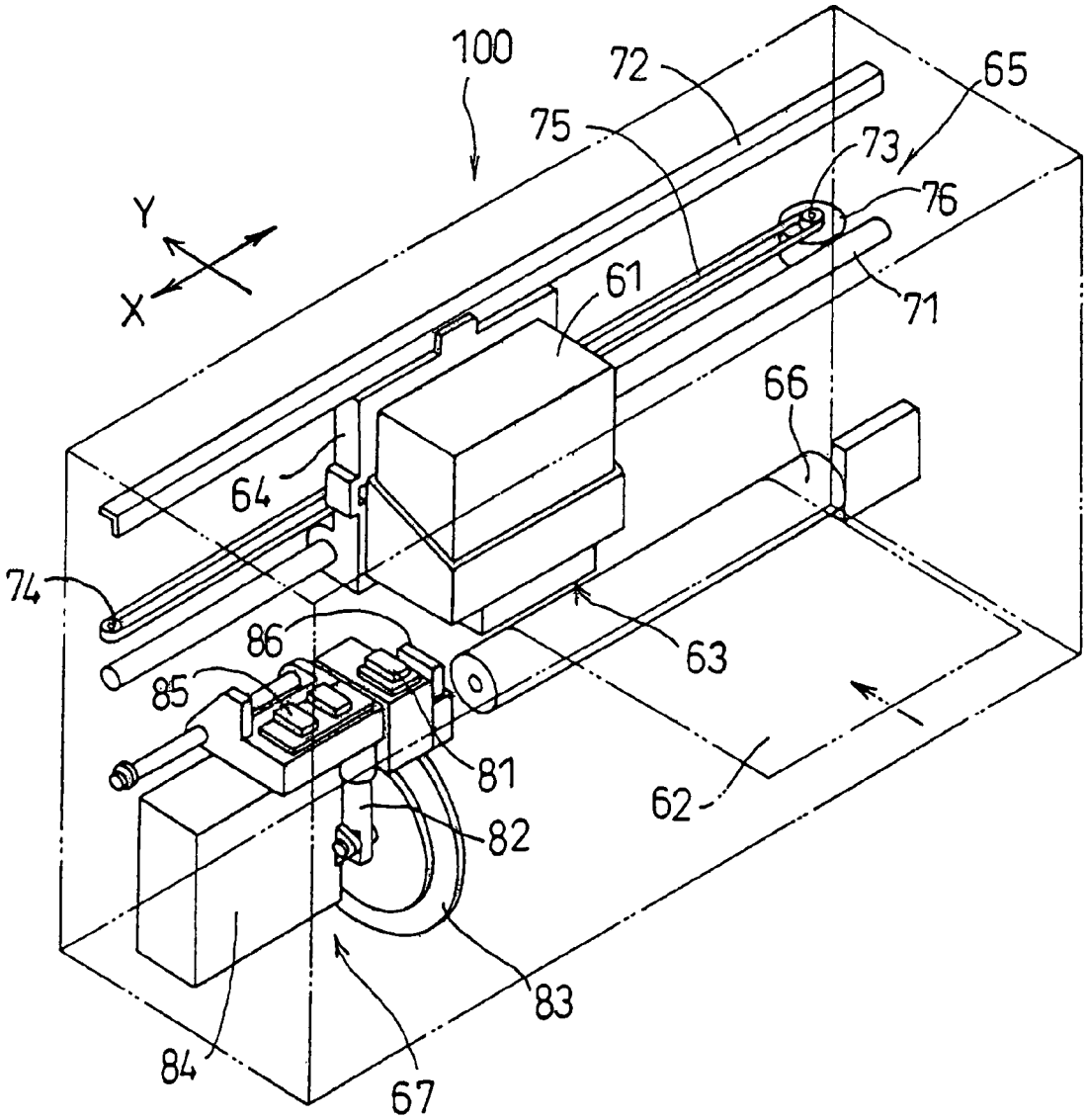
FIG. 1 is a perspective view of an ink jet printer to which the present invention is applied.

A first embodiment of the present invention relates to a full-color ink jet printer 100 shown in FIG. 1. The full-color ink jet printer 100 includes an ink cartridge 61 which stores four color inks, i.e., cyan, magenta, yellow, and black inks, such that the four color inks are separated from each other in the cartridge 61. The ink jet printer 100 additionally includes an ink jet recording device 63 which records an image on a sheet of paper 62 as a sort of recording medium that is fed in a first direction, i.e., a Y direction shown in FIG. 1; a carriage 64 on which the ink cartridge 61 and the recording device 63 are mounted; a driving unit 65 which linearly reciprocates the carriage 64 in a second direction, i.e., an X direction perpendicular to the first or Y direction in which the recording sheet 62 is fed; a platen roller 66 which extends in the X direction and is opposed to the recording device 63; and a purging device 67.

The driving unit 65 includes a guide bar 71 which extends through a lower end portion of the carriage 64, in a direction parallel to the platen roller 66; a guide plate 72 which engages an upper end portion of the carriage 64, and extends parallel to the guide bar 71; two pulleys 73, 74 which are provided between the guide bar 71 and the guide plate 72 and in respective vicinities of axially opposite end portions of the guide bar 71; and a timing belt 75 which is wound on the two pulleys 73, 74.

When an electric motor 76 is driven or operated, the first pulley 73 is rotated, and the timing belt 75 to which the carriage 64 is secured is linearly reciprocated while the carriage 64 is guided by the guide bar 71 and the guide plate 72.

The recording sheet 62 is supplied from a sheet supplying device, not shown, in the Y direction, and is fed to a gap provided between the platen roller 66 and the recording device 63, so that a desired image is recorded, on the recording sheet 62, with the color inks ejected from the recording device 63, as will be described later. Subsequently, the recording sheet 62 is discharged from the ink jet printer 100.

The purging device 67 is provided on one side of the platen roller 66, such that when the carriage 64 is positioned at a resetting position, the purging device 67 is opposed to the recording device 63 mounted on the carriage 64. The purging device 67 includes a purging cap 81 which contacts an outer or lower surface of the recording device 63 so as to cover a plurality of ink ejection nozzles 11*a* (FIG. 7, described later) of the same 63 that open in the outer surface; an electric pump 82 and a cam 83; and an ink container 84. While the recording device 63 is positioned at the resetting position, bad inks remaining in the same 63 and containing air bubbles are sucked by the pump 82 driven by the cam 83, so that the function of the same 63 may be recovered. The bad inks sucked by the pump 82 are accumulated in the ink container 84.

A wiper member 86 is provided between the purging device 67 and the platen roller 66. The wiper 86 has a plate-like shape and, as the carriage 64 is moved, the wiper 86 wipes the lower surface of the recording device 63 and the respective open ends of the ink ejection nozzles 11*a*. When the wiper 86 is used to wipe the recording device 63, the wiper 86 is advanced upward; and when it is not used, it is retracted downward.

When the carriage 64 is moved to the resetting position after a recording operation, an ink-drying preventing cap 85 covers the ink ejection nozzles 11*a* of the recording device 63 mounted on the carriage 64. Thus, the cap 85 prevents drying of the inks present in the nozzles 11*a*.

Figure 2:
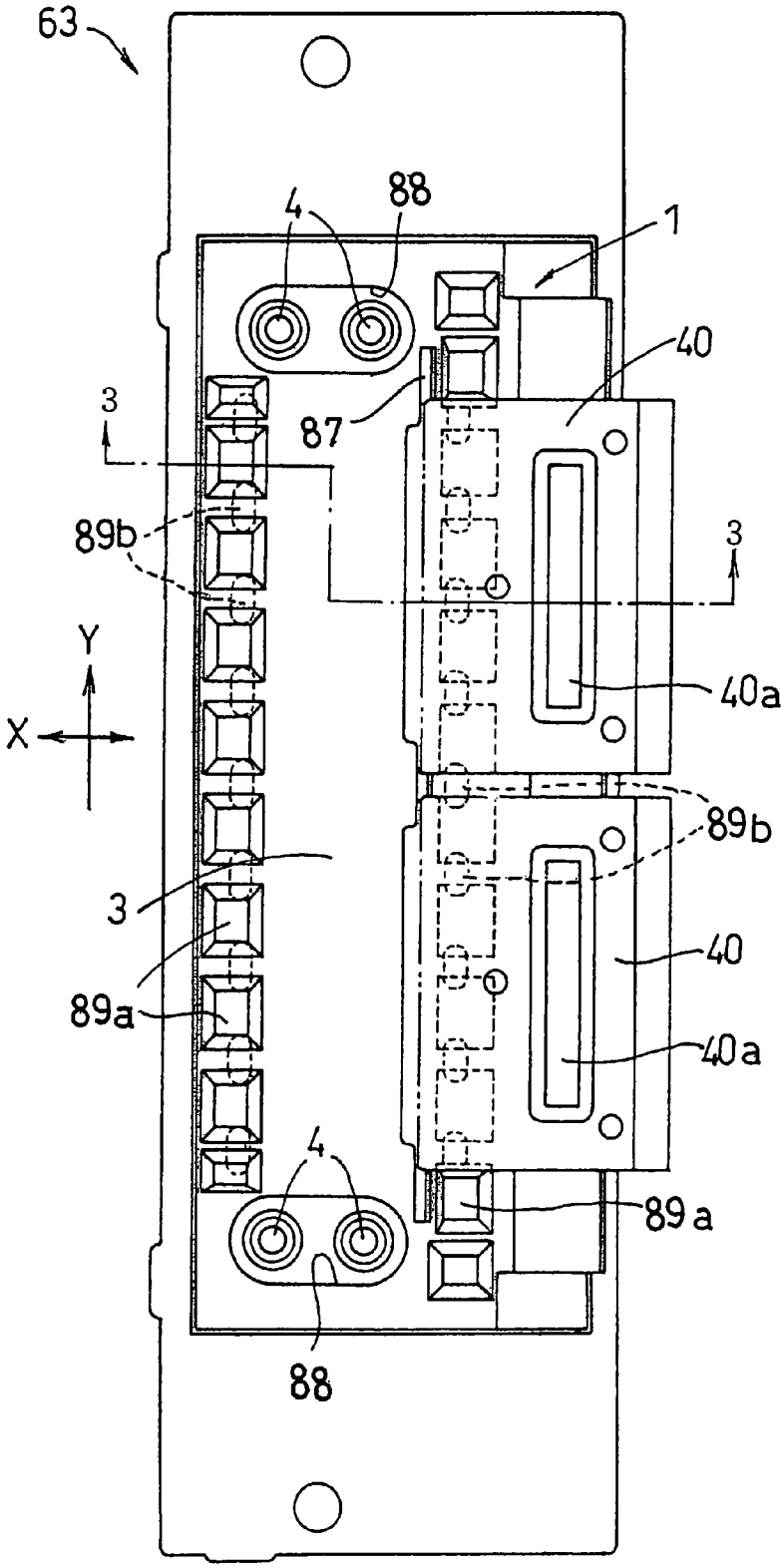
FIG. 2 is a plan view of a back or upper surface of a piezoelectric ink jet printer head of the printer of FIG. 1.
Figure 3:
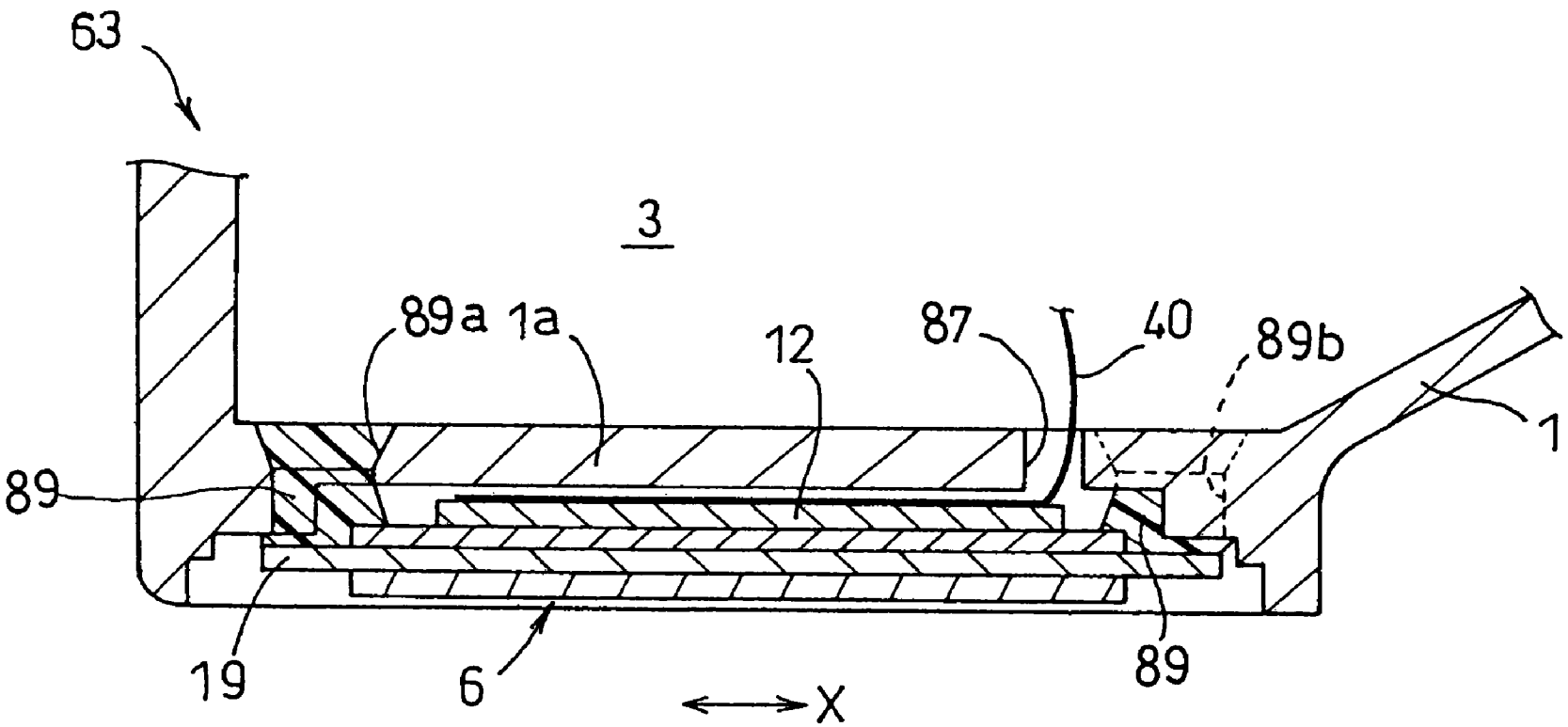
FIG. 3 is a cross-sectional view taken along 3-3 in FIG. 2.

As shown in FIGS. 2 and 3, the ink jet recording device 63 includes an ink jet printer head 6 which has, in a front surface thereof (i.e., the lower surface of the recording device 63), the ink ejection nozzles 11*a* that are arranged in four arrays in the Y direction; and a head holder 1 to which a back surface of the printer head 6 is fixed with an adhesive 89, described later.

The head holder 1 includes an ink-cartridge holding portion 3 which holds the above-described ink cartridge 61, and the ink cartridge 61 supplies the four color inks to the printer head 6 via respective cylindrical ink-supply sleeves 4, as will be described later.

As shown in FIGS. 2 and 3, a bottom wall 1*a* of the head holder 1 defines a lower surface of the ink-cartridge holding portion 3, and has a slit 87 through which two flexible flat cables 40, 40 connected to the printer head 6 are passed; two elliptic holes 88, 88 through which the two pairs of ink-supply sleeves 4 projecting from the printer head 6 are passed, respectively; and a plurality of first holes 89*a* and a plurality of second holes 89*b* into which the adhesive 89 is poured to fix opposite extension portions of a highly rigid spacer sheet 19, described later, to the bottom wall 1*a* of the head holder 1. The adhesive 89 is, e.g., an UV-light (ultraviolet-light) sensitive adhesive as a sort of a photo-curing adhesive. Each of the two flexible flat cables 40 functions as a wiring substrate.

The slit 87 is formed in an intermediate portion of the bottom wall 1*a* of the head holder 1, and is elongate in the Y direction. Each of the first holes 89*a* formed through about half the thickness of the bottom wall 1*a* has an inverted-trapezoidal cross section, i.e., an upper open end of the each through-hole 89*a* has an area larger than that of a lower open end of the same 89*a*. Both the first group of holes 89*a* and the second group of holes 89*b* are provided along two long sides of the bottom wall la, i.e., in the Y direction, such that the holes 89*a*, 89*b* are opposed to respective upper surfaces of the extension portions of the highly rigid spacer sheet 19 as part of the printer head 6.

Figure 4:
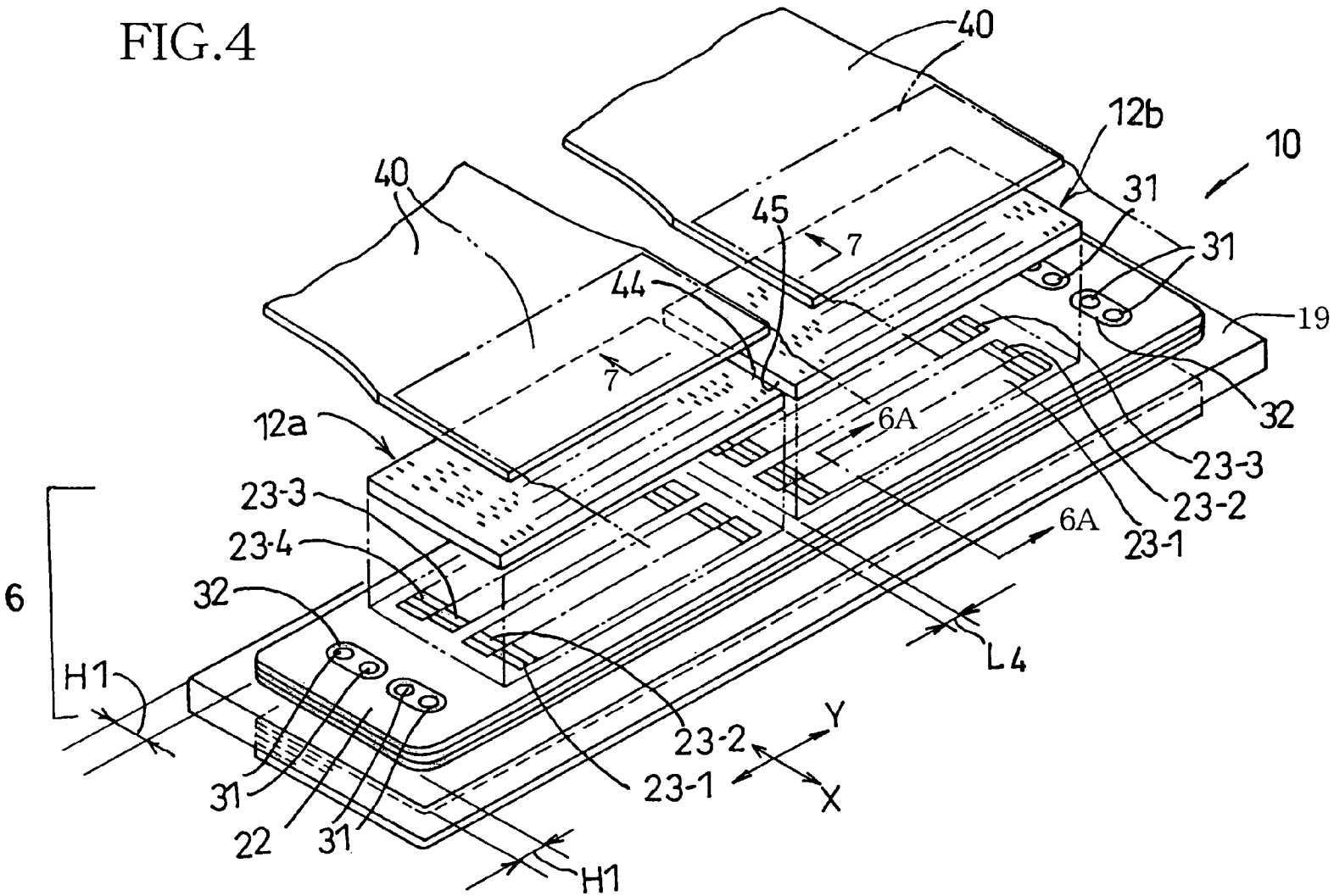
FIG. 4 is a perspective view of the piezoelectric ink jet printer head, a cavity unit, two piezoelectric actuators, and two flexible flat cables of the printer head being separated from each other for illustrative purposes only.

Next, there will be described a construction of the ink jet printer head 6. As shown in FIG. 4, the printer head 6 includes a cavity unit 10 which is constituted by a plurality of sheet members stacked on each other; two sheet-stacked-type piezoelectric actuators 12 (12*a*, 12*b*) each of which is stacked on, and fixed with adhesive to, the cavity unit 10; and the two flexible flat cables 40, 40 which are stacked on, and bonded to, respective upper or back surfaces of the two piezoelectric actuators 12*a*, 12*b*, so as to connect electrically the actuators 12*a*, 12*b* to an external device, not shown.

As shown in FIGS. 2 and 4, the printer head 6 has an elongate shape in the Y direction in which the ink ejection nozzles 11*a* are arranged, and accordingly the head holder 1 to which the printer head 6 is attached is also elongate in the Y direction.

The cavity unit 10 is constructed as shown in FIGS. 4, 5, 6A, and 6B. More specifically described, the cavity unit 10 includes nine flat sheet members that are stacked on, and bonded with adhesive to, each other. The nine sheets include, in the order from the bottom, to the top, of the cavity unit 10, a nozzle sheet 11, an intermediate sheet 15, a damper sheet 16, two manifold sheets 17, 18, the (first) spacer sheet 19, a second and a third spacer sheet 20, 21, and a base sheet 22. The base sheet 22 has a plurality of pressure chambers 23 arranged in four arrays.

The first spacer sheet 19 as one of the three spacer sheets 19, 20, 21 has a rigidity higher than those of the other sheet members 11, 15 through 18, and 20 through 22.

Thus, the cavity unit 10 has an increased rigidity. In the present embodiment, the "rigidity" of the cavity unit 10 is defined as its flexural rigidity against an external force to deform or curve the cavity unit 10 having such a flat shape that its dimension in the direction of stacking (i.e., respective thickness) of the sheet members 11, 15 through 22 is considerably small relative to its lengthwise and widthwise dimensions. The flexural rigidity of the cavity unit 10 is the product of its modulus of longitudinal elasticity and its cross-sectional secondary moment, and is exhibited against its flexural vibration or its bending deformation caused by the external force exerted perpendicularly to its major surfaces in the state in which its outer peripheral portions are secured.

The rigidity of the cavity unit 10 is increased as follows: Each of the other sheet members 15 through 22 than the nozzle sheet 11 formed of a synthetic resin, is formed of a 42% nickel alloy steel sheet, and each of the metal sheet members 15 through 18 and 20 through 22 than the first spacer sheet 19 has a thickness of from about 50 μm to about 150 μm. Only the first spacer sheet 19, stacked on the second manifold sheet 18, has a thickness of from about 300 μm to about 500 μm, and has a much higher rigidity than those of the other sheet members 11, 15 through 18, and 20 through 22. In the present embodiment, the first spacer sheet 19 has a plan-view shape larger than that of the other sheet members. More specifically described, the other sheet members have a substantially rectangular plan-view contour, whereas the first spacer sheet 19 has a similar rectangular plan-view contour, but extends outward from that of the other sheet members by an appropriate dimension H1, as shown in FIG. 4.

For the purpose of increasing the rigidity of the first spacer sheet 19, the first spacer sheet 19 may be formed of a material having a higher strength (i.e., a higher modulus of elasticity). For example, the other metal sheet members 15 through 18 and 20 through 22 are formed of a tough hardening chromium steel, whereas the first spacer sheet 19 is formed of a nickel chromium molybdenum steel, stainless steel, tungsten steel, or cobalt chromium tungsten steel that has a higher tensile strength. Otherwise, the rigidity of the first spacer sheet 19 may be increased by quenching a carbon steel or an alloy steel used to form the metal sheet 19.

In the present embodiment, the rigidity of the first spacer sheet 19, provided above the second manifold sheet 18, is increased as described above. However, in addition to, or in place of, the rigidity of the first spacer sheet 19, the rigidity of the third space sheet 21, provided below the base sheet 22 having the pressure chambers 23, and/or the rigidity of the second spacer sheet 20 provided between the first and third spacer sheets 19, 21 may be increased. In the case where only a single spacer sheet is provided between the base sheet 22 and the second manifold sheet 18, the rigidity of that single spacer sheet is increased.

The nozzle sheet 11 has the plurality of ink ejection nozzles 11*a* each having a small diameter (e.g., about 25 μm), such that the nozzles 11*a* are arranged in two pairs of arrays, i.e., four arrays in total, and each pair of arrays of nozzles 11*a* are arranged in a staggered or zigzag fashion in the first direction, i.e., a lengthwise direction of the cavity unit 10 or the printer head 6, or the Y direction shown in FIG. 4.

Figure 6A:
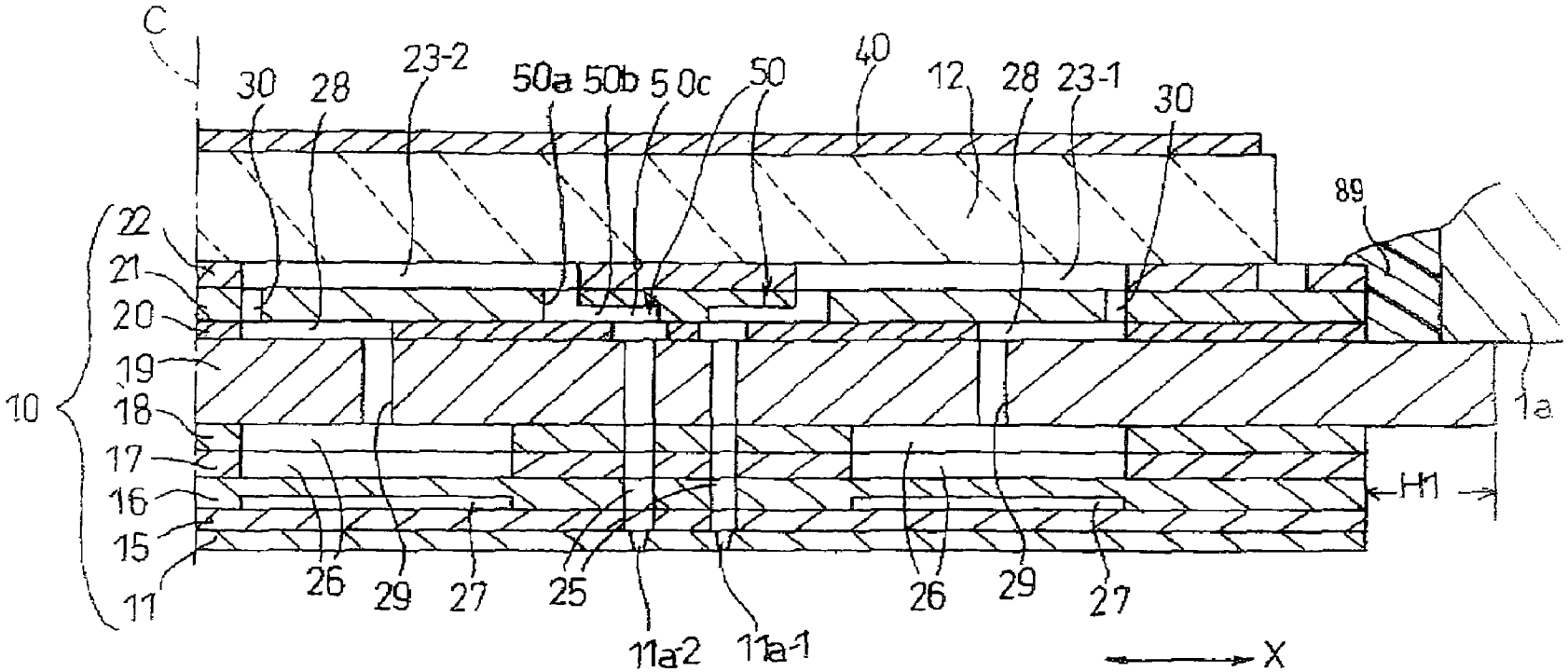
FIG. 6A is an enlarged, cross-sectional view taken along 6A-6A in FIG. 4.
Figure 7:
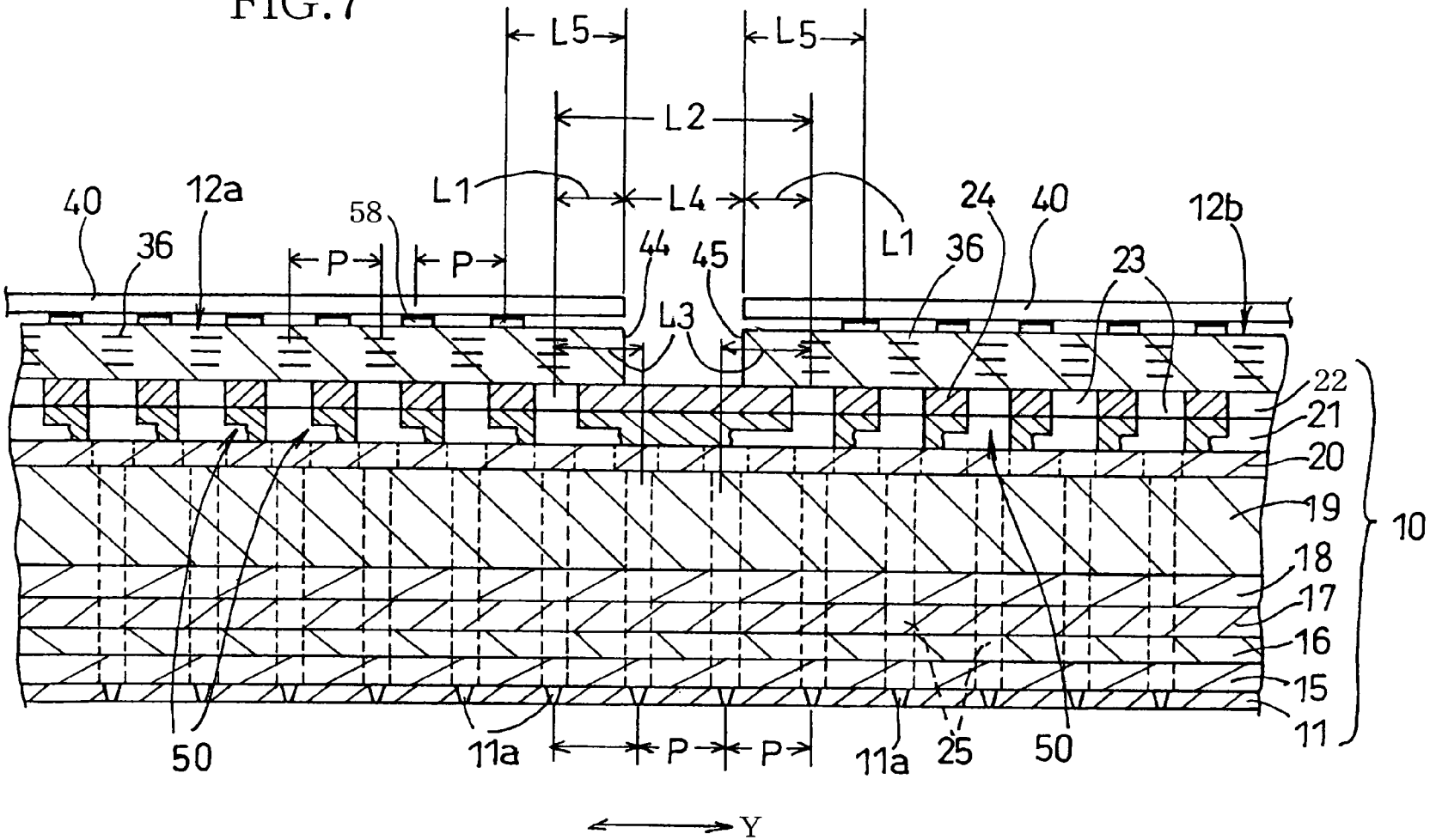
FIG. 7 is an enlarged, cross-sectional view taken along 7-7 in FIG. 4.

FIG. 6A is a cross-sectional view of the cavity unit 10, taken along 6A-6A in FIG. 4, i.e., in the X direction, i.e., a widthwise direction of the cavity unit 10 or the printer head 6. More specifically described, FIG. 6A shows a half portion of the cavity unit 10, located on a right-hand side of a centerline, C, of the cavity unit 10 that is parallel to the Y direction. The right-hand half portion of the cavity unit 10 has the first array of nozzles 11*a*-1 remote from the centerline C, and the second array of nozzles 11*a*-2 near to the centerline C. The two arrays of nozzles 11*a*-1, 11*a*-2 are arranged along respective reference lines, not shown, that are near to each other and each parallel to the Y direction, in the above-described zigzag fashion, and the nozzles of each array 11*a*-1, 11*a*-2 are formed through the thickness of the nozzle sheet 11, at a regular small pitch, P, (FIG. 7). Likewise, a left-hand half portion of the cavity unit 10 has the third array of nozzles 11*a* near to the centerline C, and the fourth array of nozzles 11*a* remote from the centerline C. The two arrays of nozzles 11*a* are arranged along respective reference lines, not shown, that are near to each other and each parallel to the Y direction, in the zigzag fashion, and the nozzles 11*a* of each array are formed through the thickness of the nozzle sheet 11, at the regular small pitch P. The first and second arrays of nozzles 11*a*-1, 11*a*-2, i.e., the first pair of arrays of nozzles 11*a*, and the third and fourth arrays of nozzles 11*a*, i.e., the second pair of arrays of nozzles 11*a* are parallel to each other, and are distant from each other in the widthwise direction of the cavity unit 10 or the printer head 6, i.e., the second or X direction. In the present embodiment, each of the first to fourth arrays of nozzles 11*a* is two-inch long, and consists of 150 nozzles. Thus, the density of nozzles 11*a* of the printer head 6 is 75 dpi (dot per inch).

Figure 5:
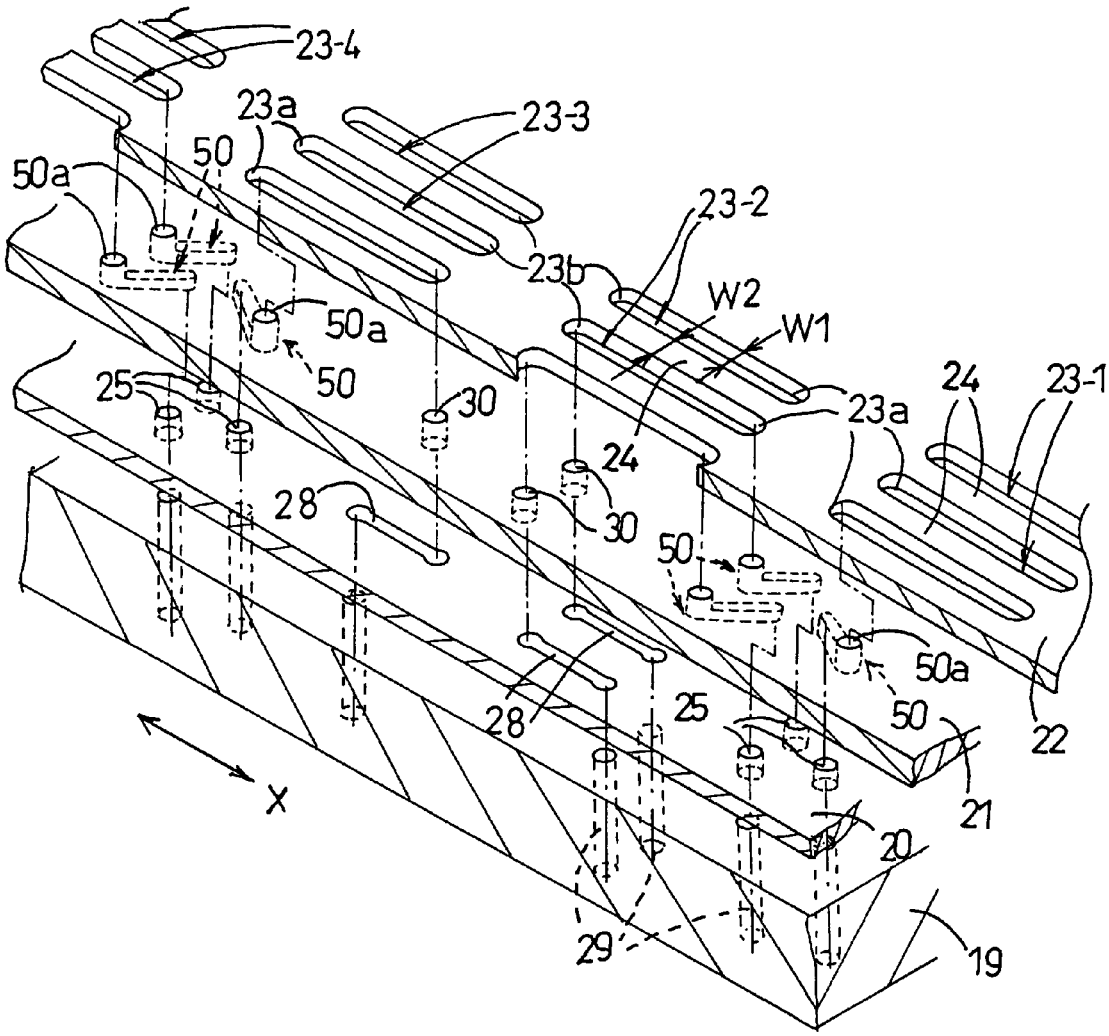
FIG. 5 is a perspective, exploded view of a portion of the cavity unit.

FIG. 4 shows the base sheet 22 as an uppermost sheet or layer of the cavity unit 10. The base sheet 22 has the four arrays of pressure chambers 23 (23-1, 23-2, 23-3, 23-4) corresponding to the four arrays of nozzles 11*a*, respectively, such that the arrays of pressure chambers 23 extend in the lengthwise direction of the cavity unit 10, i.e., the Y direction. The pressure chambers 23 are formed through the thickness of the base sheet 22, at the same pitch P as the pitch P at which the nozzles 11*a* are formed, as shown in FIG. 7. Each of the pressure chambers 23 is elongate in a direction substantially parallel to the widthwise direction of the cavity unit 10, i.e., the X direction. Thus, each pair of pressure chambers 23 located adjacent each other are separated from each other by a partition wall 24 that is elongate in a direction substantially parallel to the X direction, as shown in FIGS. 5 and 7. Each of the partition walls 24 has a width W2 that is somewhat smaller than a width W1 of each of the pressure chambers 23.

The pressure chambers of the first array 23-1 communicate with the nozzles of the first array 11*a*-1, respectively. Likewise, the pressure chambers of the second array 23-2 communicate with the nozzles of the second array 11*a*-2, respectively; the pressure chambers of the third array 23-3 communicate with the nozzles 11*a* of the third array, respectively; and the pressure chambers of the fourth array 23-4 communicate with the nozzles 11*a* of the fourth array, respectively.

Next, there will be described a positional relationship between the four arrays of pressure chambers 23 of the base sheet 22 as the uppermost sheet of the cavity unit 10, and four arrays of active portions of the two piezoelectric actuators 12 (12*a*, 12*b*), by reference to FIGS. 4 and 7. The two piezoelectric actuators 12*a*, 12*b* are provided on the base sheet 22, such that respective longitudinal axes of the two actuators 12*a*, 12*b* are aligned with each other in the same direction as the direction in which the four arrays of nozzles 11*a* extend, i.e., in the first or Y direction.

As shown in FIGS. 4 and 7, the two piezoelectric actuators 12*a*, 12*b* operate respective half portions of the four arrays of pressure chambers 23 communicating with the four arrays of nozzles 11*a*, and accordingly each actuator 12*a*, 12*b* has seventy-five active portions to operate the seventy-five pressure chambers 23 as the half portion of each of the four arrays of pressure chambers 23. Thus, one of the two piezoelectric actuators 12*a*, 12*b* is provided on one of two half portions of the upper surface of the cavity unit 10 in the lengthwise direction thereof, i.e., in the Y direction; and the other piezoelectric actuator is provided on the other half portion of the upper surface of the same 10.

Figure 8:
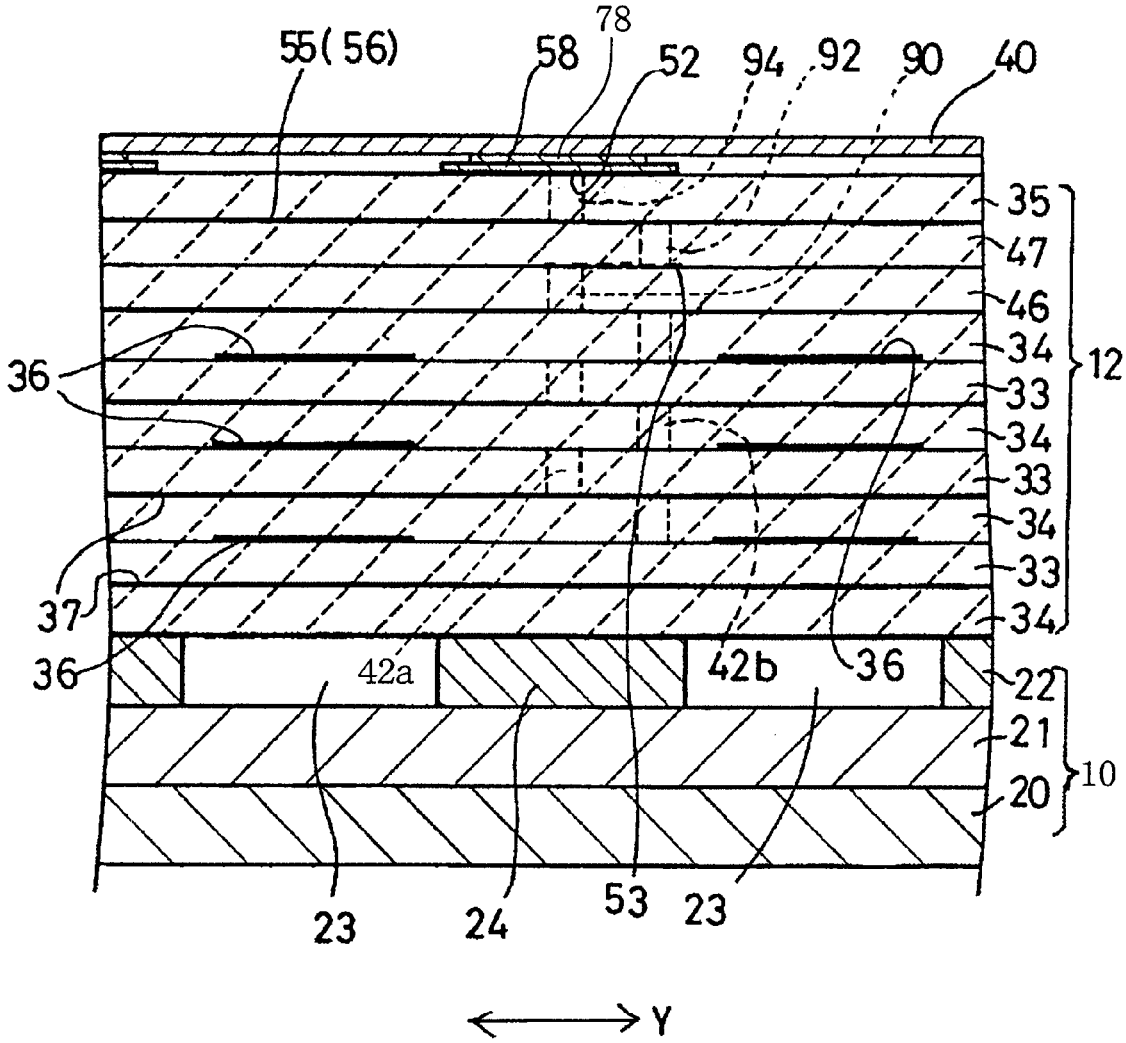
FIG. 8 is an enlarged, cross-sectional view of a portion of one of the two piezoelectric actuators.

As will be described later by reference to FIG. 8, each of the active portions of each piezoelectric actuator 12*a*, 12*b* includes, for a corresponding one of the pressure chambers 23, respective portions of seven piezoelectric sheets 33, 34 stacked on each other, and three proper individual electrodes 36 and respective portions of four proper common electrodes 37 that are alternate with each other and are also alternate with the respective portions of the seven piezoelectric sheets 33, 34. When an electric voltage is applied to the proper individual and common electrodes 36, 37 of an arbitrary one of the active portions, the one active portion is deformed, by longitudinal piezoelectric effect, in the direction of stacking of the piezoelectric sheets 33, 34. Thus, the two piezoelectric actuators 12*a*, 12*b* cooperate with each other to provide the same number of active portions as the number of the pressure chambers 23 of the cavity unit 10, such that the active portions are arranged in the same number of arrays as the number (i.e., four) of the arrays of pressure chambers 23, and are formed at the respective positions aligned with the pressure chambers 23 in the direction of stacking of the sheets 33, 34, as shown in FIGS. 7 and 8.

In short, the active portions of the two piezoelectric actuators 12*a*, 12*b* are arranged in the four arrays in the same direction as the direction in which the ink ejection nozzles 11*a* or the pressure chambers 23 are arranged, i.e., in the Y direction, and the same number of active portions as the number (i.e., four) of the arrays of the nozzles 11*a* are arranged in the X direction. Each of the active portions is elongate in the X direction in which a corresponding one of the pressure chambers 23 is elongate, i.e., the widthwise direction of the cavity unit 10 or the printer head 6. The active portions of each of the four arrays are provided at the same pitch P as the pitch at which the pressure chambers 23 are provided, as shown in FIG. 7. The first and second arrays of active portions corresponding to the first and second arrays of pressure chambers 23-1, 23-2 are arranged in the zigzag fashion and, likewise, the third and fourth arrays of active portions corresponding to the third and fourth arrays of pressure chambers 23-3, 23-4 are arranged in the zigzag fashion.

As shown in FIG. 4, the pressure chambers 23 are grouped into two groups corresponding to the two piezoelectric actuators 12*a*, 12*b* that are arranged in the lengthwise direction of the cavity unit 10, i.e., the Y direction. More specifically described, the first group of pressure chambers 23 corresponding to the first piezoelectric actuator 12*a* are located in one of two half portions of the base sheet 22 in the Y direction parallel to the arrays of nozzles 11*a*; and the second group of pressure chambers 23 corresponding to the second piezoelectric actuator 12*b* are located in the other half portion of the base sheet 22. In each of the two groups of pressure chambers 23, the pressure chambers 23 are arranged in the four arrays, such that first and second arrays of pressure chambers are arranged in the zigzag fashion and the third and fourth arrays of pressure chambers are also arranged in the zigzag fashion, and such that the pressure chambers of each of the four arrays are provided at the same pitch P as the pitch at which the nozzles 11*a* are provided.

Each of the pressure chambers 23 is elongate in the widthwise direction of the cavity unit 10, i.e., in the second or X direction, and is formed through the thickness of the base sheet 22. Each pressure chamber 23 has an inlet end 23*b* that communicates with a corresponding one of eight manifold chambers 26, described later, via a second ink passage 30 formed in the third spacer sheet 21, a restrictor passage 28 formed in the second spacer sheet 20, and a first ink passage 29 formed in the first spacer sheet 19, as shown in FIGS. 5 and 6A.

In addition, each of the pressure chambers 23 has an outlet end 23*a* that communicates with a corresponding one of the ink ejection nozzles 11*a* via respective communication passages 25 as respective ink channels that are formed in the three spacer sheets 21, 20, 19, the two manifold sheets 18, 17, the damper sheet 16, and the intermediate sheet 15 all of which are interposed between the base sheet 22 and the nozzle sheet 11. One of the communication passages 25 that is formed in the third spacer sheet 21 is provided in the form of a bottomed groove 50 that extends substantially parallel to a plane defined by a lower surface of the sheet 21. However, at least one of the communication passages 25 that is formed in at least one of the sheet members 21 through 15 interposed between the base sheet 22 and the nozzle sheet 11 may be provided in the form of the bottomed groove 50. Thus, as shown in FIGS. 5 and 7, the outlet end 23*a* of each pressure chamber 23 from which ink flows out is distant from the corresponding ink ejection nozzle 11*a* by a distance, L3, in the first or Y direction.

More specifically described, as shown in FIGS. 4 and 7, the above-indicated two groups of pressure chambers 23 of the cavity unit 10, i.e., the respective groups of active portions of the two piezoelectric actuators 12*a*, 12*b* are distant from each other by a distance, L2, that is longer than the regular pitch P at which the pressure chambers 23 or the active portions are arranged in each group in the lengthwise direction of the base sheet 22. Meanwhile, it is difficult to manufacture each piezoelectric actuator 12*a*, 12*b* in such a manner that a distance, L1, between the proper individual electrodes 36 of the respective outermost active portions of the four arrays of active portions of the each piezoelectric actuator 12*a*, 12*b*, and a corresponding end 44, 45 of the same 12*a*, 12*b* is not greater than half the regular pitch P at which the proper individual electrodes 36 are provided in the each actuator 12*a*, 12*b* in the lengthwise direction of the same 12*a*, 12*b*. Therefore, it is easier to manufacture the piezoelectric actuators 12*a*, 12*b* such that the distance L1 is greater than half the pitch P, i.e., L1>P/2, and accordingly the distance L2 is greater than the pitch P, i.e., L2>P.

In addition, as shown in FIGS. 4 and 7, the two piezoelectric actuators 12*a*, 12*b* are arranged in series on the cavity unit 10, such that the respective ends 44, 45 of the two actuators 12*a*, 12*b* are opposed to each other and are distant from each other by a distance, L4, i.e., L2=2L1+L4.

That is, all the nozzles 11*a* of each of the four arrays are arranged at the regular pitch P, but each of the nozzles 11*a* is distant from a corresponding one of the pressure chambers 23 by the distance L3 in the first or Y direction. As described above, the outlet end 23*a* of each pressure chamber 23 communicates with the corresponding nozzle 11*a* via the communication passages 25 at least one of which is provided in the form of the bottomed groove 50 extending parallel to the plane defined by at least one 21 of the sheet members 21 through 15 in which the bottomed groove 50 is formed. Therefore, the other communication passages 25 are simply formed vertically through the respective thickness of the other sheet members 20 through 15, and are connected to one of opposite ends of the bottomed groove 50 formed in the sheet member 21. Owing to this simple construction, each nozzle 11*a* is made distant from the corresponding pressure chamber 23 by the distance L3 in the first or Y direction. However, as shown in FIG. 5, each of the bottomed grooves 50 extends not only in the first direction but also in the second direction in which the corresponding pressure chamber 23 extends. Thus, the two groups of bottomed grooves 50 corresponding to the two groups of pressure chambers 23 are symmetrical with each other with respect to a bisector of the distance L2, such that each of the bottomed grooves 50 is inclined relative to the bisector.

In the present embodiment, the bottomed grooves 50 are formed in the third spacer sheet 21 located adjacent the lower surface of the base sheet 22 having the pressure chambers 23. The bottomed grooves 50 are described below in more detail by reference to FIGS. 5 and 6A. Each of the bottomed grooves 50 includes one end 50*a* opening in the upper surface of the third spacer sheet 21 and communicating with the outlet end 23*a* of the corresponding pressure chamber 23; a bottomed horizontal passage 50*b* opening in the lower surface of the third spacer sheet 21; and another end 50*c* communicating with an upper end of the corresponding vertical communication passage 25 formed through the thickness of the second spacer sheet 20 located below the third spacer sheet 21.

Thus, the communication passages 25 as the ink channels connecting between the pressure chambers 23 of the base sheet 22 and the corresponding nozzles 11*a* of the nozzle sheet 11 can be easily designed such that the corresponding nozzles 11*a* are largely deviated from the pressure chambers 23, because at least one of the communication passages 25 corresponding to each pressure chamber 23 is provided in the form of the bottomed groove 50 extending parallel to the plane defined by the third spacer sheet 21, and the other communication passages 25 are formed through the respective thickness of the other sheet members 20 through 15 in the respective directions perpendicular to the respective planes defined by those sheet members 20 through 15. In addition, it is also easy to design respective overall lengths of the communication passages 25 as the ink channels connecting between the pressure chambers 23 and the corresponding nozzles 11*a* (each overall length is defined as including the length of the corresponding bottomed groove 50), such that the respective overall lengths of the communication passages 25 are substantially equal to each other.

The two manifold sheets 17, 18 cooperate with each other to define the eight manifold chambers 26, such that the manifold chambers 26 extend along the arrays of nozzles 11*a*, respectively. More specifically described, each of the manifold chambers 26 has a length corresponding to a quotient obtained by dividing the length of each array of pressure chambers 23 in the first direction, by an appropriate integral number. In the present embodiment, each manifold chamber 26 has a length corresponding to the length of each array of pressure chambers 23 in each of the above-described two groups. Each group has seventy-five pressure chambers 23 in each array. Thus, the length of each manifold chamber 26 corresponds to the length of seventy-five pressure chambers arranged in the first direction. Thus, the two manifold sheets 17, 18 define the eight manifold chambers 26 in total. One of lengthwise opposite ends of each of the eight manifold chambers 26 communicates with a corresponding one of eight ink supply holes 31 that are formed in the three spacer sheets 19, 20, 21 and the base sheet 22 that are stacked on the manifold sheets 17, 18, as shown in FIG. 4.

Each of the eight manifold chambers 26 is formed, by etching, through the respective thickness of the two manifold sheets 17, 18, and is fluid-tightly closed by the first spacer sheet 19 stacked on the upper manifold sheet 18, and the damper sheet 16 located beneath the lower manifold sheet 17. The damper sheet 16 has eight damper chambers 27 which are formed, by etching, in a lower surface of the sheet 16 and each of which has a plan-view shape identical with that of each manifold chamber 26.

A pressure wave that is applied by the piezoelectric actuator 12*a*, 12*b* to each pressure chamber 23 includes a backward component that propagates backward via ink to the corresponding manifold chamber 26. This backward component is effectively absorbed by vibration of the thin damper sheet 16, and so-called "cross-talk" between two or more pressure chambers 23 located adjacent each other is prevented.

Figure 6B:
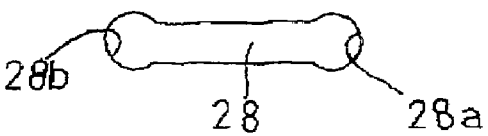
FIG. 6B is an enlarged, plan view of a restrictor passage formed in a sheet member of the cavity unit.

The second spacer sheet 20 has the restrictor passages 28 each of which restricts the flow of ink. As shown in FIG. 6B, each of the restrictor passages 28 has a plan-view shape including two axially opposite end portions 28*a*, 28*b*, and an intermediate portion whose width is smaller than that of the end portions 28*a*, 28*b*. Each restrictor passage 28 is elongate in a direction parallel to the direction in which the corresponding pressure chamber 23 is elongate. Each restrictor passage 28 is fluid-tightly closed by the third spacer sheet 21 stacked on an upper surface of the second spacer sheet 20, and the first spacer sheet 19 located beneath a lower surface of the same 20. As shown in FIGS. 5 and 6A, the first spacer sheet 19 has the first ink passages 29 which are formed through the thickness thereof and each of which communicates with a corresponding one of the manifold chambers 26 and with the one end portion 28*a* of a corresponding one of the restrictor passages 28; and the third spacer sheet 21 has the second ink passages 30 which are formed through the thickness thereof and each of which communicates with the inlet end 23*b* of a corresponding one of the pressure chambers 23 and with the other end portion 28*b* of a corresponding one of the restrictor passages 28.

As shown in FIG. 4, the cavity unit 10 has the eight ink-supply holes 31 corresponding to the eight manifold chambers 26, i.e. the four pairs of ink-supply holes 31 corresponding to the four color inks, respectively. Each pair of ink-supply holes 31 are covered with a filter 32 which is fixed with adhesive to an upper surface of the base sheet 22 and which removes dust from the corresponding ink supplied from the ink cartridge 61.

As shown in FIG. 2, the four cylindrical sleeves 4 are provided on the upper surface of the base sheet 22, such that the four sleeves 4 are aligned with the four filters 32, i.e., the four pairs of ink-supply holes 31, respectively, so that the four sleeves 4 receive the four color inks, respectively, from the ink cartridge 61. Each of the four sleeves 4 has an inner ink-flow passage, and includes a lower large-diameter portion and an upper small-diameter portion, and a lower end surface of the each sleeve 4 is strongly adhered and fixed with, e.g., an epoxy resin to the corresponding filter 32. In addition, an annular elastic seal member, not shown, such as a rubber packing or an O-ring is fitted on the upper small-diameter portion of each sleeve 4, so that the each sleeve 4 can be connected to the ink cartridge 61 via a flow-channel member, not shown, while the ink is prevented from leaking from the each sleeve 4.

Next, there will be described a construction of each of the two piezoelectric actuators 12*a*, 12*b*. As shown in FIG. 8, each piezoelectric actuator 12*a*, 12*b* includes ten sheet members stacked on each other. The ten sheet members include the seven piezoelectric ceramic sheets 33, 34 each having a thickness of about 30 μm; two binder layers or sheets 46, 47 stacked on the piezoelectric sheets 33, 34; and a top sheet 35 stacked on the binder sheets 46, 47. Each of the binder sheets 46, 47 and the top sheet 35 may be provided by a piezoelectric ceramic sheet, or any other sort of electrically insulating material.

Figure 10:
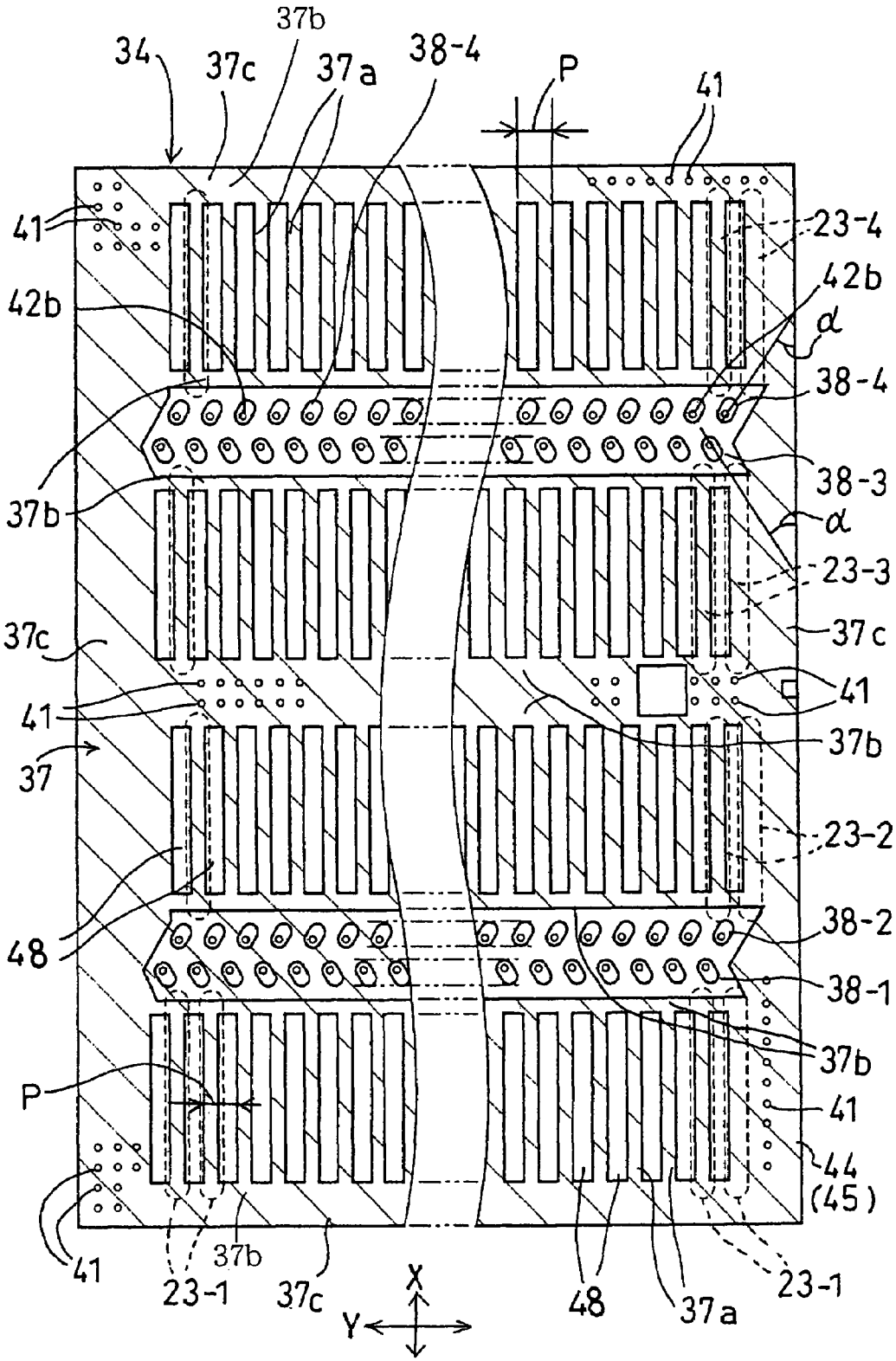
FIG. 10 is an enlarged, plan view of a piezoelectric sheet of the piezoelectric actuator, showing a proper common electrode, a portion of the piezoelectric sheet being cut away.
Figure 11:
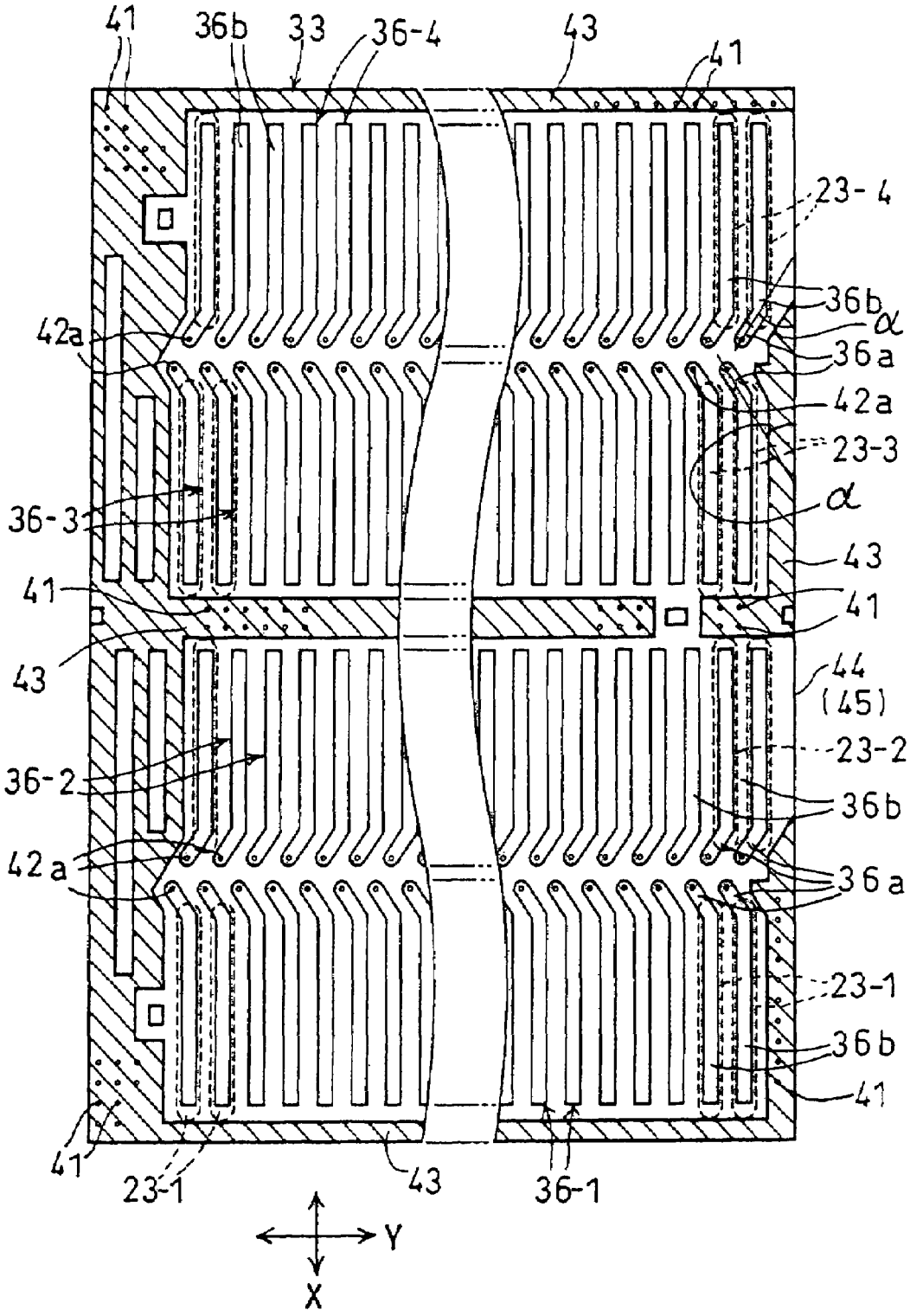
FIG. 11 is an enlarged, plan view of a piezoelectric sheet of the piezoelectric actuator, showing proper individual electrodes, a portion of the piezoelectric sheet being cut away.

The seven piezoelectric sheets 33, 34 include three first piezoelectric sheets 33 and four second piezoelectric sheets 34, such that the four second sheets 34 and the three first sheets 33 are alternate with each other in the direction of stacking of the sheets 33, 34. As shown in FIG. 10, a proper common electrode 37 is provided on a planar upper surface of each of the four second sheets 34; and, as shown in FIG. 11, a proper-individual-electrode layer or pattern, i.e., four arrays of proper individual electrodes 36 (36-1, 36-2, 36-3, 36-4) each having a small width are provided on a planar upper surface of each of the three first sheets 33, at respective positions corresponding to the pressure chambers 23 (23-1, 23-2, 23-3, 23-4, indicated by broken lines) of the cavity unit 10. The four arrays of proper individual electrodes 36-1, 36-2, 36-3, 36-4 extend in the first direction, i.e., the lengthwise direction of each first piezoelectric sheet 33 or the Y direction in which the four arrays of nozzles 11*a* extend.

As shown in FIG. 11, the first and fourth arrays of proper individual electrodes 36-1, 36-4 of each proper-individual-electrode layer are located along opposite long sides of the corresponding first piezoelectric sheet 33. The second and third arrays of proper individual electrodes 36-2, 36-3 are located on respective widthwise intermediate portions of the first piezoelectric sheet 33.

Each of the proper individual electrodes 36 of each proper-individual-electrode layer extends parallel to opposite short sides of the corresponding first piezoelectric sheet 33, in the second direction (or the X direction) perpendicular to the first direction. Each of the proper individual electrodes 36 (36-1, 36-2, 36-3, 36-4) includes a straight portion 36*b* which has a length substantially equal to that of each pressure chamber 23 (23-1, 23-2, 23-3, 23-4), indicated by broken lines in FIG. 11, and a width somewhat smaller than that of the same 23. Each proper individual electrode 36 overlaps, in its plan view, the corresponding pressure chamber 23. Respective end portions 36*a* of the proper individual electrodes 36 of the first array 36-1 are located near to respective end portions 36*a* of the proper individual electrodes 36 of the second array 36-2; and respective end portions 36*a* of the proper individual electrodes 36 of the third array 36-3 are located near to respective end portions 36*a* of the proper individual electrodes 36 of the fourth array 36-4. The end portion 36*a* of each proper individual electrode 36 is inclined, in its plan view, by an angle, $\alpha$ (e.g., about 60 degrees), relative to the straight portion 36*b* of the same 36, such that the end portion 36*a* reaches a position distant from the corresponding pressure chamber 23. More specifically described, as shown in FIG. 11, each of the respective end portions 36*a* of the proper individual electrode 36 is inclined, in its plan view, in a direction away from the end 44, 45 of each piezoelectric actuator 12*a*, 12*b*. In addition, the respective end portions 36*a* of the proper individual electrodes 36 of the first array 36-1 and the respective end portions 36*a* of the proper individual electrodes 36 of the second array 36-2 are so inclined as to approach each other; and, likewise, the respective end portions 36*a* of the proper individual electrodes 36 of the third array 36-3 and the respective end portions 36*a* of the proper individual electrodes 36 of the fourth array 36-4 are so inclined as to approach each other.

As shown in FIGS. 9 through 12, each of the respective end portions 36*a* of the proper individual electrodes 36 is located at a position where the each end portion 36*a* at least partly overlaps, in its plan view, a corresponding one of dummy individual electrodes 38 provided on each of the second piezoelectric sheets 34 except for the bottom sheet 34, and a corresponding one of first connection members 53 provided on the lower binder sheet 46, and is electrically connected to a corresponding one of internal connection electrodes 42*a* extending through the thickness of each first sheet 33 except for the lowermost sheet 33, a corresponding one of internal connection electrodes 42*b* extending through the thickness of each second piezoelectric sheet 34 except for the bottom sheet 34, and a corresponding one of internal connection electrodes 90 extending through the thickness of the lower binder sheet 46.

As shown in FIG. 11, on each of the three first piezoelectric sheets 33, there is provided a dummy common electrode 43 that partly overlaps, in its plan view, the proper common electrode 37 provided on each second piezoelectric sheet 34, such that the dummy common electrode 43 surrounds the first and second arrays of proper individual electrodes 36-1, 36-2 and also surrounds the third and fourth arrays of proper individual electrodes 36-3, 36-4.

Figure 15:
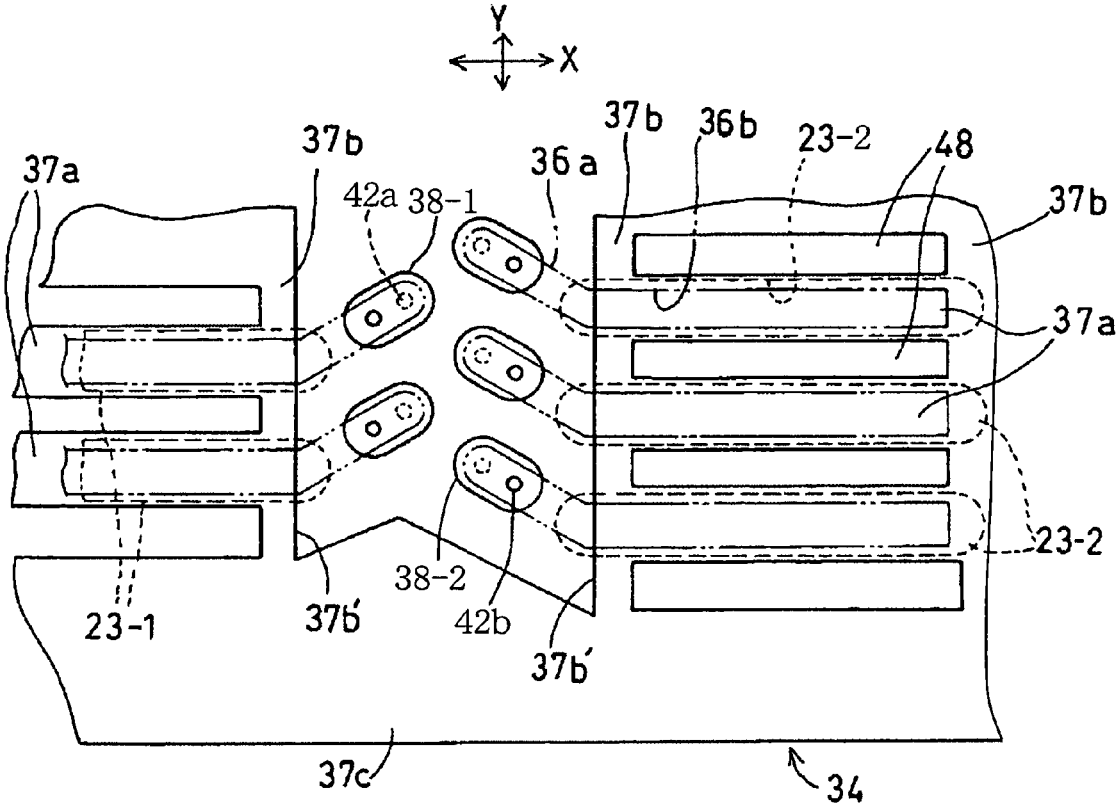
FIG. 15 is an enlarged, plan view of a piezoelectric sheet of the piezoelectric actuator, showing the proper common electrode in more detail, a portion of the piezoelectric sheet being cut away.

As shown in FIGS. 8, 10 and 15, each of the four proper common electrodes 37 is formed, by printing, on a corresponding one of the four second piezoelectric sheets 34. Each proper common electrode 37 includes four arrays of individual electrically conductive portions 37*a* that overlap, in their plan view, the four arrays of pressure chambers 23-1, 23-2, 23-3, 23-4, respectively, and the four arrays of proper individual electrodes 36-1, 36-2, 36-3, 36-4, respectively, and are elongate in the X direction, i.e., in the lengthwise direction of the pressure chambers 23 or the respective straight portions 36*b* of the proper individual electrodes 36. Each proper common electrode 37 additionally includes eight common electrically conductive portions 37*b* that electrically connect, in the first direction or the Y direction, respective opposite ends of the individual electrically conductive portions 37*a* of the four arrays that correspond to the respective opposite ends 23*a*, 23*b* of the pressure chambers 23 of the four arrays. More specifically described, a first one of the eight common conductive portions 37*b* electrically connects the respective one ends of the first conductive portions 37*a* of the first array corresponding to the pressure chambers of the first array 23-1; and a second one of the eight common conductive portions 37*b* electrically connects the respective other ends of the first conductive portions 37*a* of the first array. Likewise, the third and fourth common conductive portions 37*b* electrically connect the respective opposite ends of the individual conductive portions 37*a* of the second array corresponding to the pressure chambers of the second array 23-2; the fifth and sixth common conductive portions 37*b* electrically connect the respective opposite ends of the individual conductive portions 37*a* of the third array corresponding to the pressure chambers of the third array 23-3; and the seventh and eighth common conductive portions 37*b* electrically connect the respective opposite ends of the individual conductive portions 37*a* of the fourth array corresponding to the pressure chambers of the fourth array 23-4. The structure of each proper common electrode 37 will be described in more detail by reference to FIGS. 10 and 15. Each of the individual conductive portions 37*a* has a rectangular shape in its plan view, and has a lengthwise dimension substantially equal to that of each pressure chamber 23. Each of the common conductive portions 37*b* connects the respective one (or other) ends of the individual conductive portions 37*a*, at the respective positions right above the respective lengthwise one (or other) ends 23*a*, 23*b* of the pressure chambers 23, and extends in the Y direction in which the arrays of pressure chambers 23 extend. Therefore, each proper common electrode 37 has four arrays of strip-like openings 48 that are defined by the individual and common conductive portions 37*a*, 37*b* and are located right above the four arrays of partition walls 24 present among the four arrays of pressure chambers 23.

Each proper common electrode 37 additionally includes a rectangular, peripheral, electrically conductive portion 37*c* including two long portions along the two long sides of the piezoelectric sheet 34, and two short portions along the two short sides of the same 34. The individual and common conductive portions 37*a*, 37*b* are integrally connected to the peripheral conductive portion 37*c*. The individual conductive portions 37*a* of each of the four arrays are arranged at the same pitch P as the pitch at which the proper individual electrodes of each array 36-1, 36-2, 36-3, 36-4 are arranged, i.e., the pressure chambers 23 of each array are arranged, as shown in FIG. 10.

As shown in FIGS. 10 and 15, between respective edge lines 37*b*' of the second and third common conductive portions 37*b* of each proper common electrode 37 provided on the corresponding second piezoelectric sheet 34, there are provided first and second arrays of generally elliptic dummy individual electrodes 38-1, 38-2 that correspond to the first and second arrays of pressure chambers 23-1, 23-2; and between respective edge lines 37*b*' of the sixth and seventh common conductive portions 37*b* of the each proper common electrode 37, there are provided third and fourth arrays of generally elliptic dummy individual electrodes 38-3, 38-4 that correspond to the third and fourth arrays of pressure chambers 23-3, 23-4. The dummy individual electrodes 38 of each array are arranged at a certain regular pitch in the first direction in which the arrays of pressure chambers 23 or the arrays of proper individual electrodes 36 extend, such that each of the dummy individual electrodes 38 at least partly overlaps, in its plan view, not the straight portion 36*b*, but the end portion 36*a*, of a corresponding one of the proper individual electrodes 36. Each elliptic dummy individual electrode 38 extends, in its plan view, in the same direction as the direction in which the end portion 36*a* of the corresponding proper individual electrode 36 extends. In other words, each dummy individual electrode 38 and the end portion 36*a* of the corresponding proper individual electrode 36 are inclined, in their plan view, by the angle α (e.g., about 60 degrees) relative to the straight line defined by the end 44, 45 of each piezoelectric actuator 12*a*, 12*b*.

A distance between each one of the dummy individual electrodes 38 and the edge line 37*b*' of the corresponding common conductive portion 37*b* in the X direction, and a distance between each pair of dummy individual electrodes 38 located adjacent each other in the Y direction is selected at a prescribed value.

Since the dummy individual electrodes 38 are inclined, a lengthwise dimension of each dummy electrode 38 can be increased, while the distance between the each dummy electrode 38 and the edge line 37*b*' of the common conductive portion 37*b* and the distance between each pair of dummy electrodes 38 located adjacent each other are each kept at the prescribed value. In addition, a distance between the edge line 37*b*' of one common conductive portion 37*b* and the edge line 37*b*' of another common conductive portion 37*b* opposed to the one conductive portion 37*b* can be decreased as shown in FIG. 15. Therefore, even if, when the proper common electrode 37 and the four arrays of dummy individual electrodes 38 are formed by printing, the contour of each electrode 37, 38 may be deformed and/or the area of each electrode 37, 38 may be somewhat increased or decreased from a nominal value, no electric current leaks between two common and individual electrodes 37, 38, or between two individual electrodes 38, 38, located adjacent each other, upon application of an electric voltage to the electrodes 37, 38, because the prescribed distance is reliably kept. Thus, only a desired active portion or portions of each piezoelectric actuator 12*a*, 12*b* that corresponds or correspond to a desired pressure chamber or chambers 23 can be reliably operated, which leads to exhibiting an excellent printing quality of the printer head 6. Consequently the short sides of each piezoelectric actuator 12*a*, 12*b*, i.e., the X-direction dimension of the same 12*a*, 12*b* can be shortened or decreased and accordingly the printer head 6 can be reduced in size.

Figure 9:
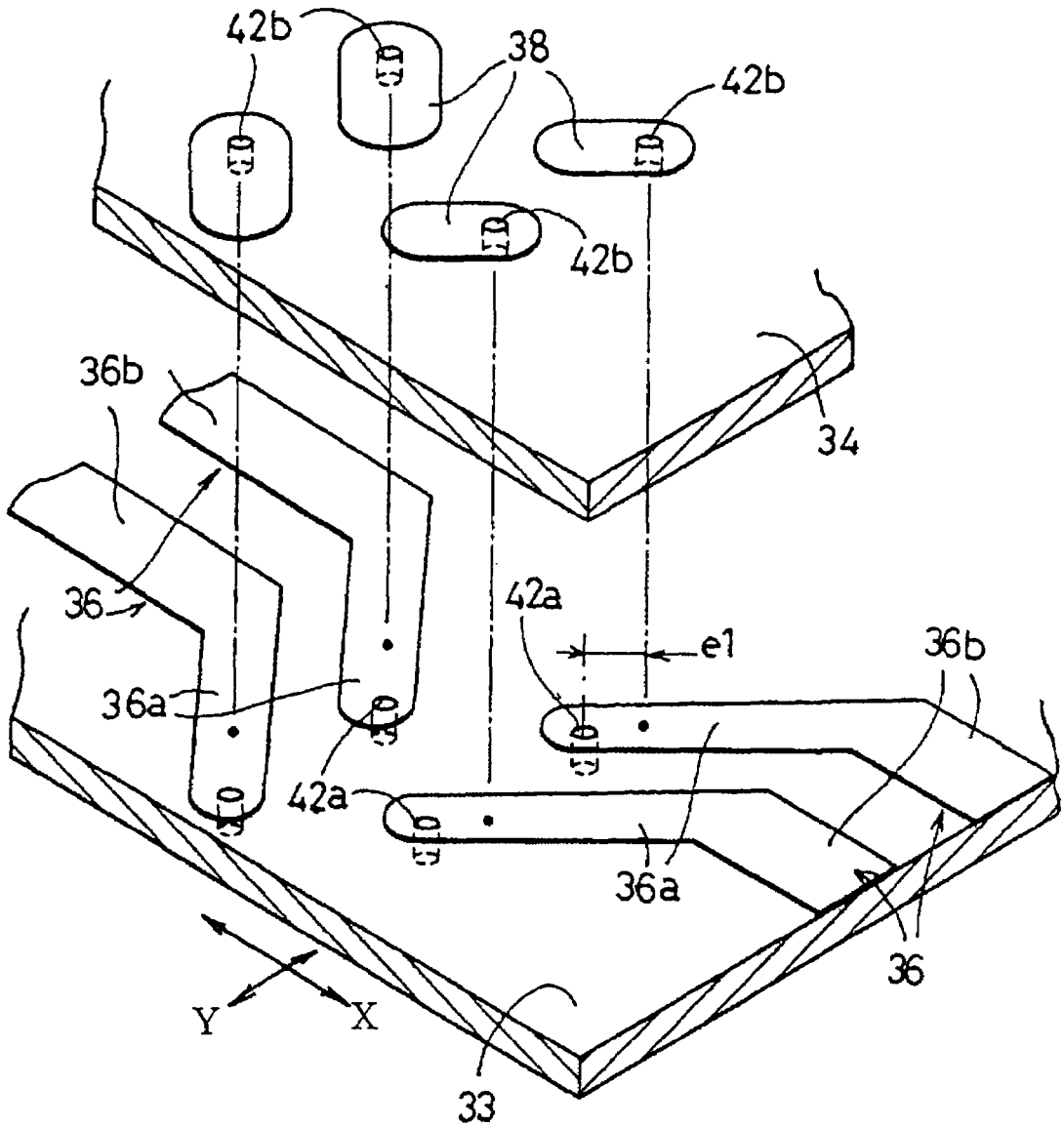
FIG. 9 is an enlarged, perspective view of respective portions of piezoelectric sheets of the piezoelectric actuator, showing a positional relationship between proper individual electrodes, dummy individual electrodes, and internal connection electrodes all of which are supported by the piezoelectric sheets.

A plurality of portions of each of the proper common electrodes 37 (in particular, the portions 37*b*, 37*c*), and a plurality of portions of each of the dummy common electrodes 43 are electrically connected to each other, in the direction of stacking of the piezoelectric sheets 33, 34, by a plurality of internal connection electrodes 41 that are formed of an electrically conductive material (i.e., an electrically conductive paste) filling a plurality of through-holes formed through the thickness of each of the piezoelectric sheets 33, 34 except for the bottom sheet 34. Similarly, the respective end portions 36*a* of the proper individual electrodes of the four arrays 36-1, 36-2, 36-3, 36-4 provided on each of the first piezoelectric sheets 33, and the dummy individual electrodes of the four arrays 38-1, 38-2, 38-3, 38-4 provided on each of the second piezoelectric sheets 34 except for the bottom sheet 34 are electrically connected to each other, in the direction of stacking of the piezoelectric sheets 33, 34, by a plurality of internal connection electrodes 42*a* that are formed of an electrically conductive material filling a plurality of through-holes formed through the thickness of each of the first piezoelectric sheets 33 except for the lowermost sheet 33, and a plurality of internal connection electrodes 42*b* that are formed of an electrically conductive material filling a plurality of through-holes formed through the thickness of each of the second piezoelectric sheets 34 except for the bottom sheet 34. As shown in FIGS. 8 and 9, each of the internal connection electrodes 42*a* provided in each first piezoelectric sheet 33, and a corresponding one of the internal connection electrodes 42*b* provided in the second piezoelectric sheet 34 located adjacent the each first sheet 33 are distant, in their plan view, from each other by an appropriate value, e1, such that the two electrodes 42*a*, 42*b* are not aligned with each other in their plan view.

Figure 12:
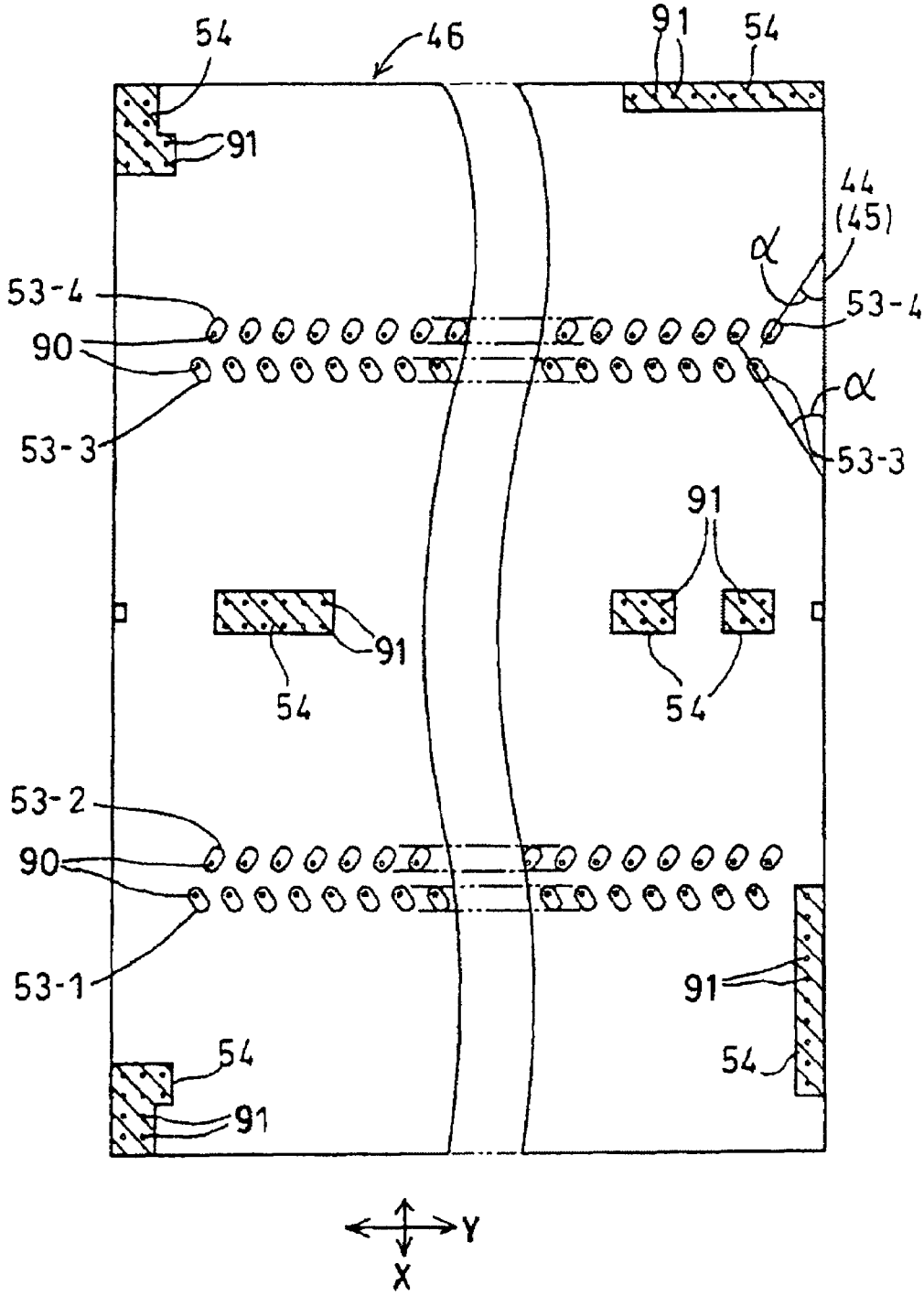
FIG. 12 is an enlarged, plan view of a lower binder sheet of the piezoelectric actuator, showing first individual connection members, a portion of the lower binder sheet being cut away.

As shown in FIGS. 8 and 12, on an upper surface of the lower one 46 of the two binder sheets 46, 47, there are provided the first connection members (electrical conductors) 53 each of which has a generally elliptic shape in its plan view and which are arranged in four arrays 53-1, 53-2, 53-3, 53-4, at a certain regular pitch in each array, such that each of the first connection members 53 at least partly overlaps, in its plan view, a corresponding one of the dummy individual electrodes of the four arrays 38-1, 38-2, 38-3, 38-4 provided on each second piezoelectric sheet 34 except for the bottom sheet 34. Each first connection member 53 is inclined, in its plan view, by the angle α (e.g., about 60 degrees) relative to the straight line defined by the end 44, 45 of each piezoelectric actuator 12*a*, 12*b* and extending in the X direction. The lower binder sheet 46 additionally has, in four corners and central portions of the upper surface thereof, respective connection members (electrical conductors) 54 each of which partly overlaps, in its plan view, the proper common electrode 37 provided on each second piezoelectric sheet 34.

Figure 13:
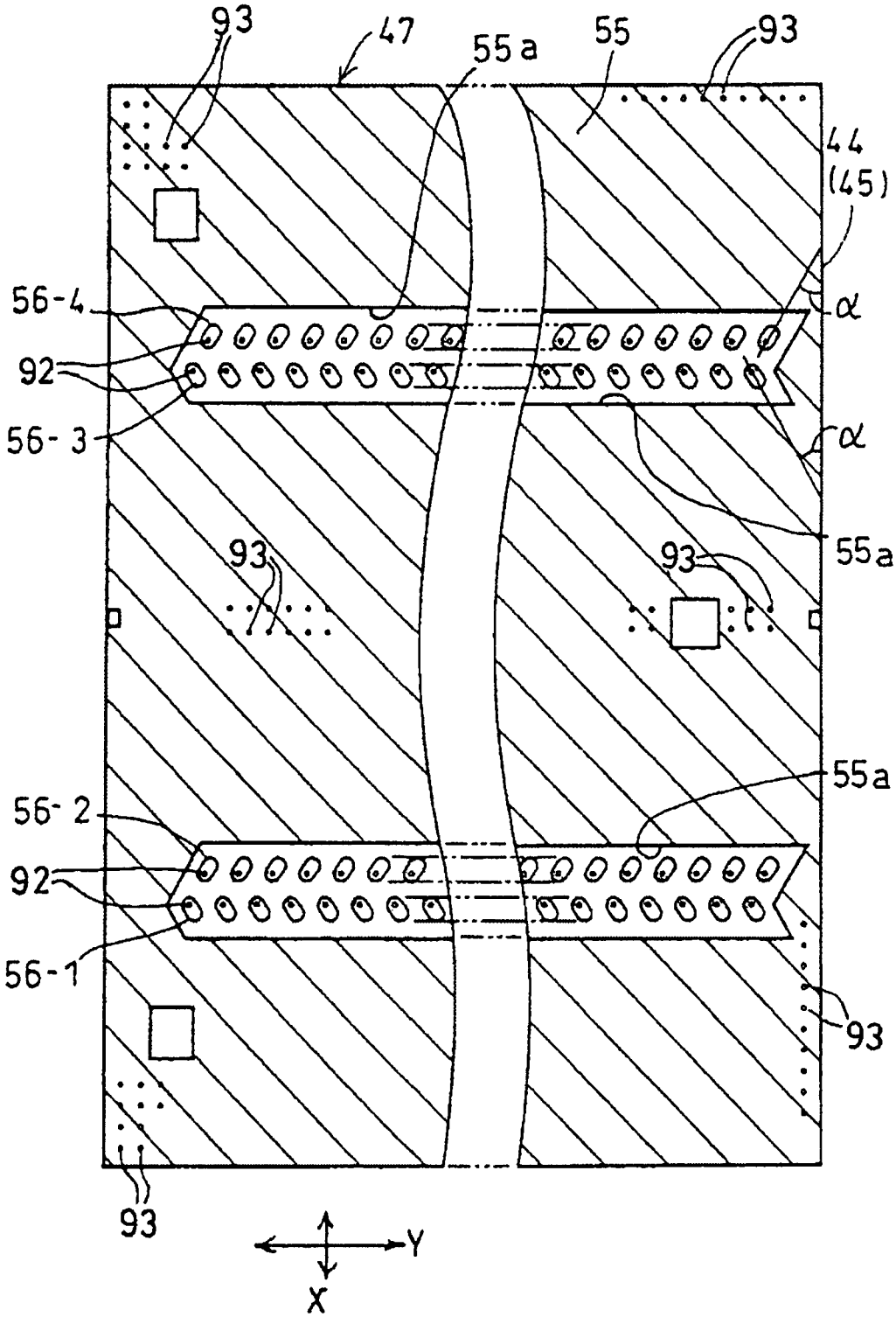
FIG. 13 is an enlarged, plan view of an upper binder sheet of the piezoelectric actuator, showing second individual connection members, a portion of the upper binder sheet being cut away.

Meanwhile, as shown in FIG. 13, on an upper surface of the upper binder sheet 47, there are provided a connection member 55 as a common electrical conductor that has, in its plan view, substantially the same size as that of each proper common electrode 37 provided on each second piezoelectric sheet 34, and overlaps the each proper common electrode 37, and second connection members 56 each of which has a generally elliptic shape in its plan view and which are arranged in four arrays 56-1, 56-2, 56-3, 56-54, at a certain regular pitch in each array, such that each of the second connection members 56 at least partly overlaps a corresponding one of the first connection members 53 of the four arrays 53-1, 53-2, 53-3, 53-4 provided on the lower binder sheet 46.

The second connection members 56 are electrically connected to the dummy individual electrodes 38 provided on each of the second piezoelectric sheets 34, via internal connection electrodes 92 extending through the thickness of the upper binder sheet 47, the first connection members 53 provided on the lower binder sheet 46, and the internal connection electrodes 90 extending through the thickness of the lower sheet 46.

Figure 18:
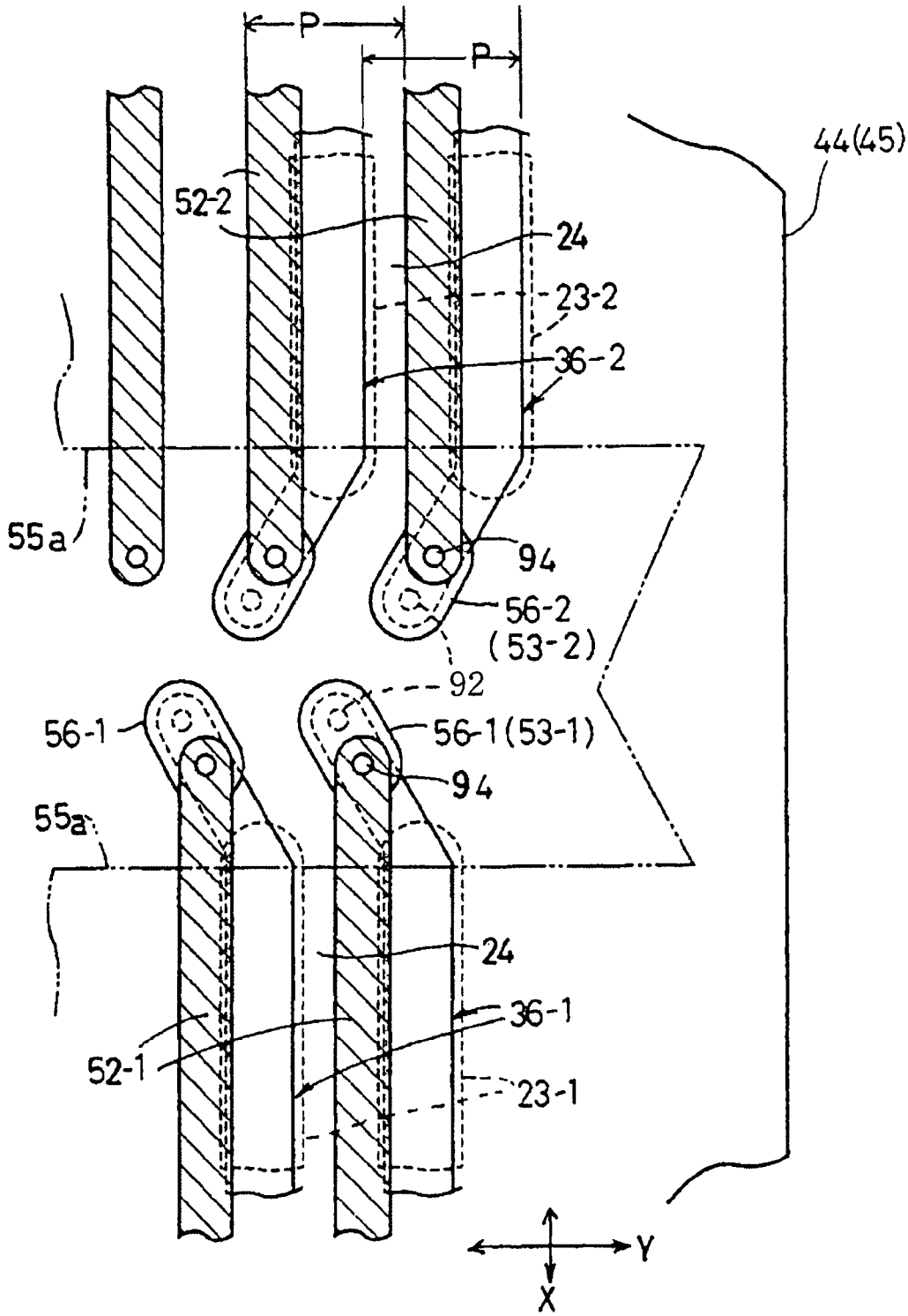
FIG. 18 is an enlarged, plan view of the top sheet of the piezoelectric actuator, showing a positional relationship between the proper individual electrode, first and second connection members, and an individual conductive member, and the pressure chamber, a portion of the piezoelectric actuator being cut away.

As shown in FIGS. 13 and 18, each second individual connection member 56 is also inclined, in its plan view, by the angle α (e.g., about 60 degrees) relative to the straight line defined by the end 44, 45 of each piezoelectric actuator 12*a*, 12*b*. In addition, a distance between each second individual connection member 56 and a straight edge line 55*a* of the corresponding common connection member 55, and a distance between each pair of second individual connection members 56, 56 located adjacent each other in the Y direction is selected at a prescribed value.

Figure 14:
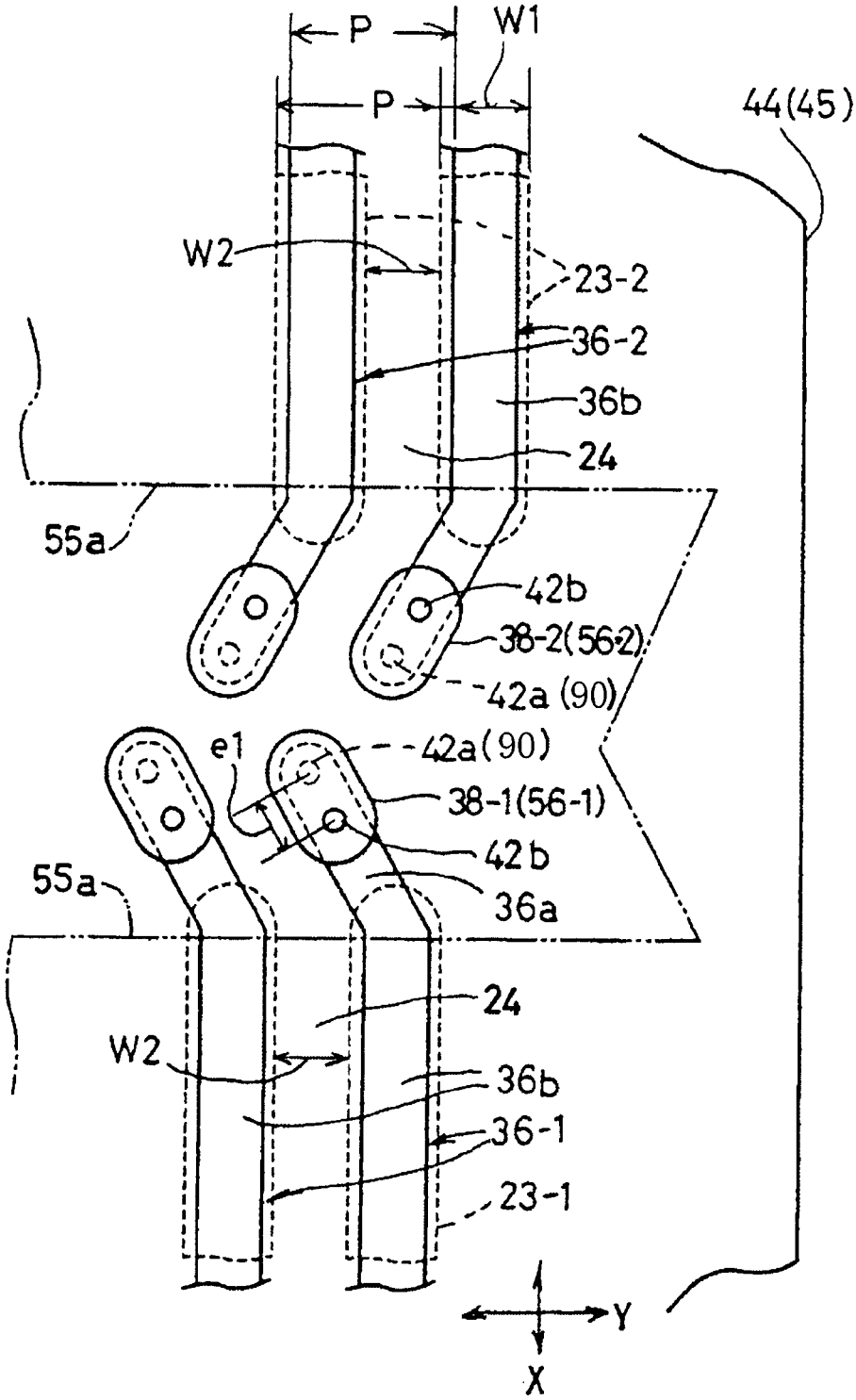
FIG. 14 is an enlarged, plan view of an active portion of the piezoelectric actuator, showing a positional relationship between proper and dummy individual electrodes and a pressure chamber, a portion of the piezoelectric actuator being cut away.

Since the second individual connection members 56 are inclined, a lengthwise dimension of each second individual connection member 56 can be increased, while the distance between the each second individual connection member 56 and the straight edge line 55*a* of the common connection member 55 in the X direction and the distance between each pair of second individual connection members 56 located adjacent each other in the Y direction are each kept at the prescribed value. In addition, a distance between the two opposed, straight edge lines 55*a*, 55*a* of the common connection member 55 can be decreased, as shown in FIGS. 14 and 18. Therefore, even if, when the common connection member 55 and the four arrays of second individual connection members 56 are formed by printing, the contour of each member 55 or 56 may be deformed and the area of each member 55, 56 may be somewhat increased or decreased from a nominal value, no electric current leaks between two members 55, 56, or two members 56, 56, located adjacent each other, upon application of an electric voltage to the members 55, 56, because the prescribed distance is reliably kept. Thus, only a desired active portion or portions of each piezoelectric actuator 12*a*, 12*b* that corresponds or correspond to a desired pressure chamber or chambers 23 can be reliably operated, which leads to exhibiting a good printing quality of the printer head 6.

Consequently the short sides of each of the piezoelectric actuators 12*a*, 12*b*, i.e., the X-direction dimension of the each piezoelectric actuator 12*a*, 12*b* can be decreased, and accordingly the printer head 6 can be reduced in size.

Figure 16:
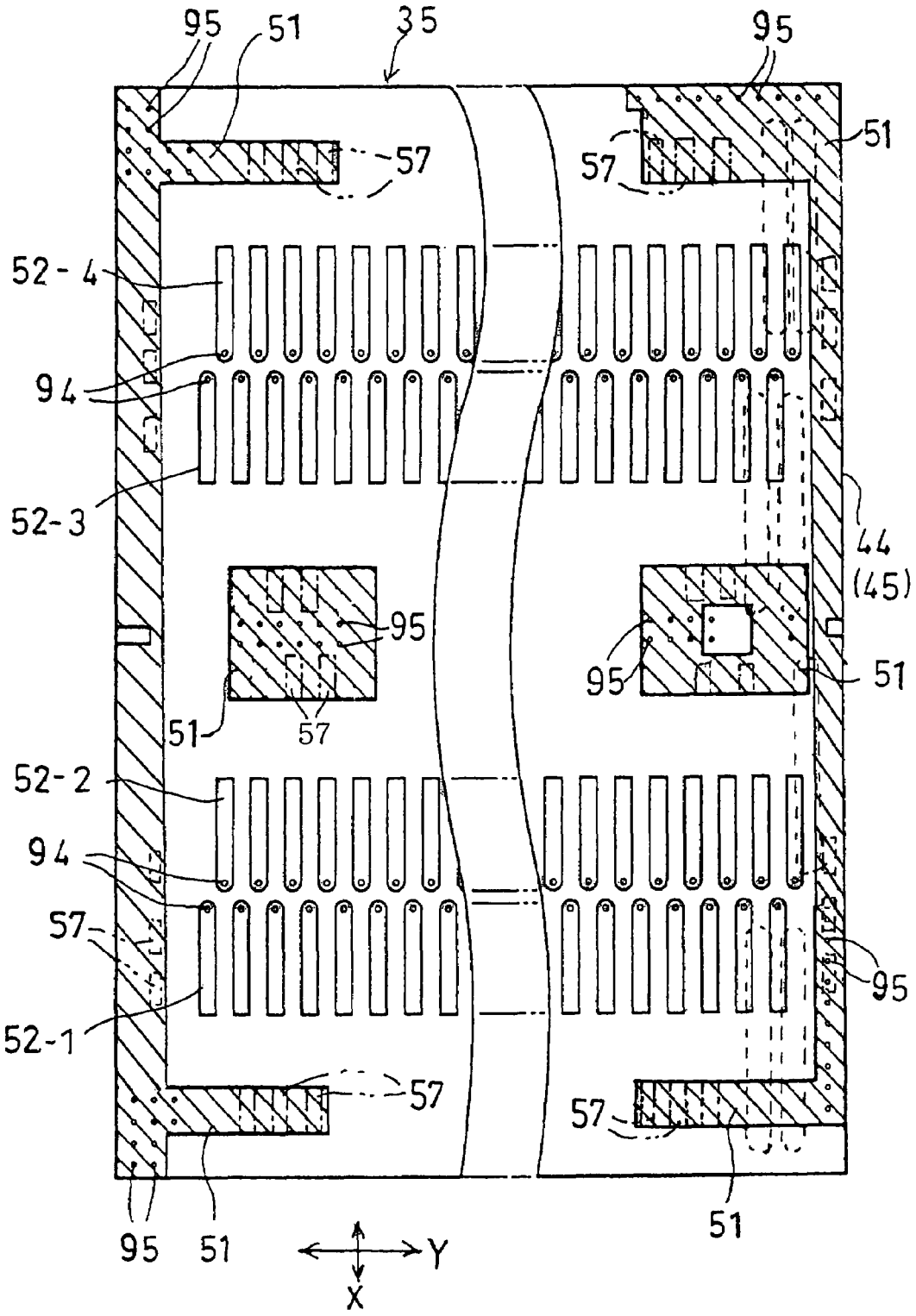
FIG. 16 is an enlarged, plan view of a top sheet of the piezoelectric actuator, showing individual conductive members, a portion of the top sheet being cut away.

As shown in FIGS. 16 and 18, on an upper surface of the top sheet 35 as the uppermost sheet of each piezoelectric actuator 12*a*, 12*b*, there are provided a plurality of common connection members (electrical conductors) 51 each of which overlaps, in its plan view, a portion of the common connection member 55 provided on the upper binder sheet 47. On the upper surface of the top sheet 35, there are additionally provided four arrays of individual connection members (electrical conductors) 52 (52-1, 52-2, 52-3, 52-4) that overlap, in their plan view, the four arrays of second individual connection members 56 (56-1, 56-2, 56-3, 56-4) provided on the upper binder sheet 47. The individual conductive members 52 of each array are arranged at the pitch P, as shown in FIG. 18.

Figure 19:
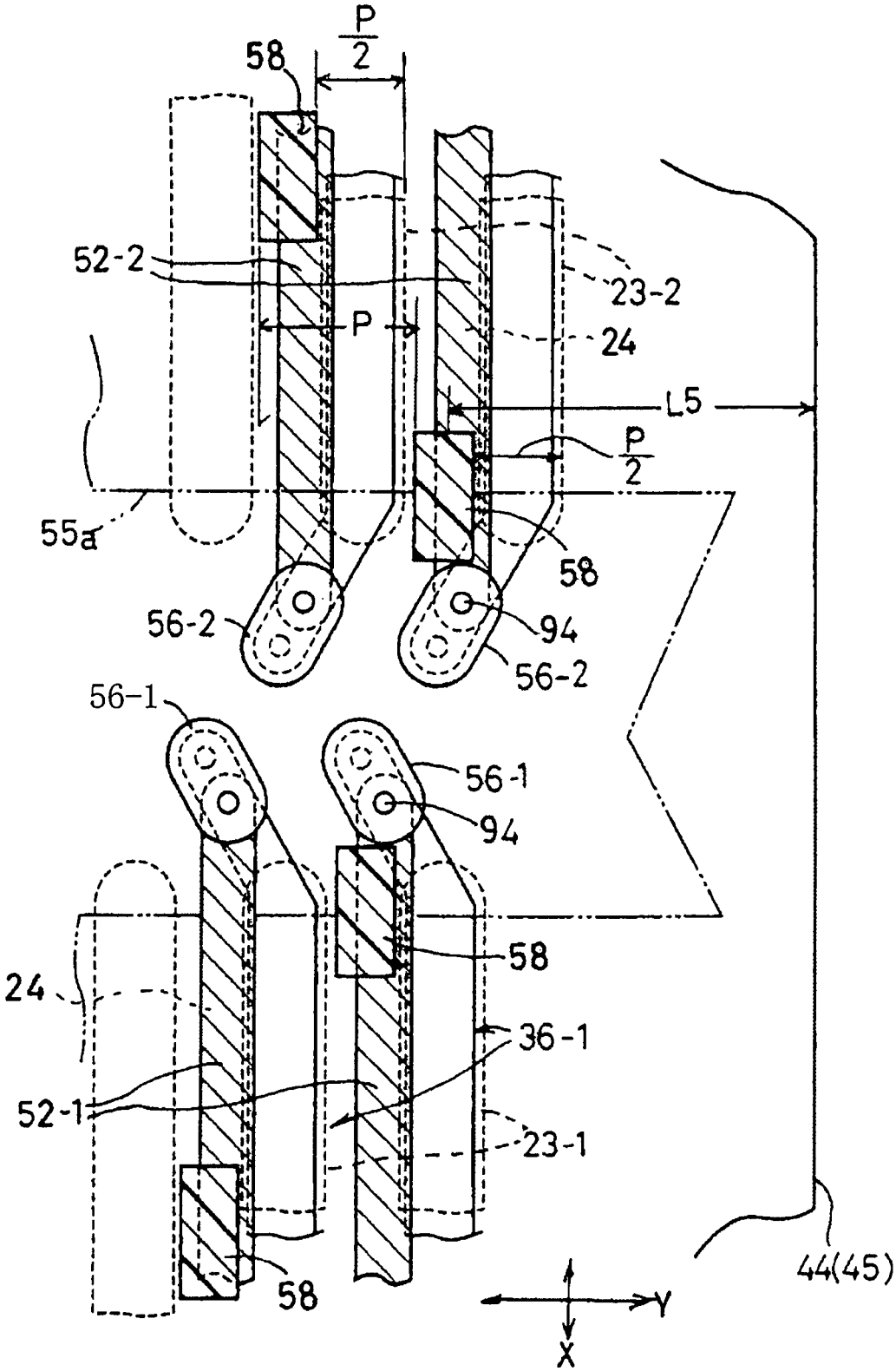
FIG. 19 is an enlarged, plan view of the top sheet of the piezoelectric actuator, showing a positional relationship between the proper individual electrode, the individual conductive member, and an individual surface electrode, and the pressure chamber, a portion of the piezoelectric actuator being cut away.

As shown in FIG. 16, each of the individual conductive members 52 (52-1, 52-2, 52-3, 52-4) extends in the X direction, i.e., in a direction parallel to the short sides of the top sheet 35 or a corresponding one of the proper individual electrodes 36 (36-1, 36-2, 36-3, 36-4). More specifically described, each individual conductive member 52 straightly extends parallel to the straight portion 36*b* of the corresponding proper individual electrode 36, such that the each conductive member 52 is shorter than the straight portion 36*b*. Moreover, as shown in FIGS. 18 and 19, each of the individual conductive members 52 (52-1, 52-2, 52-3, 52-4) provided on the upper surface of the top sheet 35 is located right above the partition wall 24 present between the two pressure chambers 23 that are located below the each conductive member 52, extend parallel to each other, and are located adjacent each other in the Y direction. Though, in the embodiment shown in FIG. 18, the center of each individual conductive member 52 is somewhat offset from the center of the partition wall 24, the center of each conductive member 52 may be aligned, in its plan view, with the center of the partition wall 24.

Figure 17:
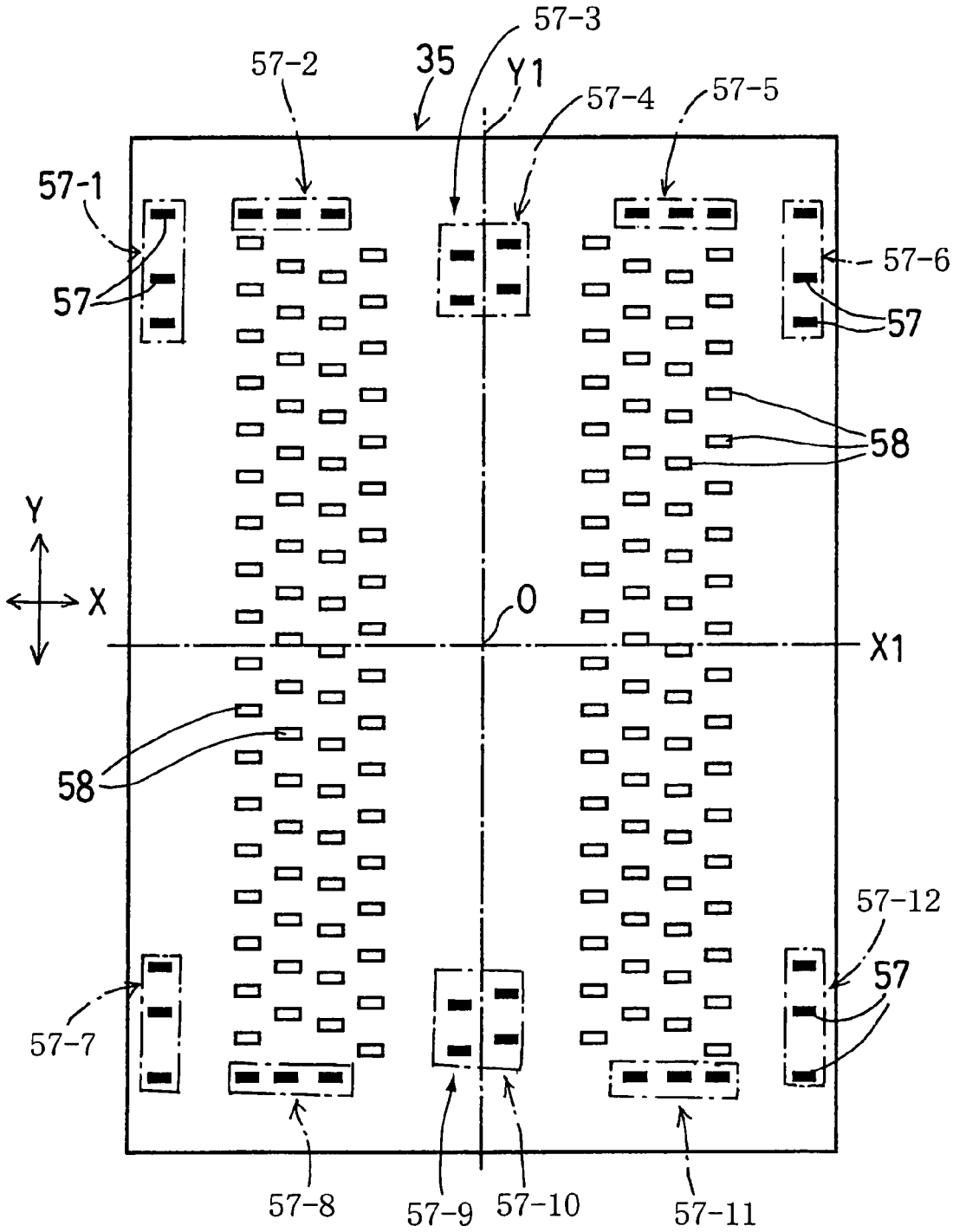
FIG. 17 is an enlarged, plan view of the top sheet of the piezoelectric actuator, showing individual surface electrodes, a portion of the top sheet being cut away.
Figure 20:
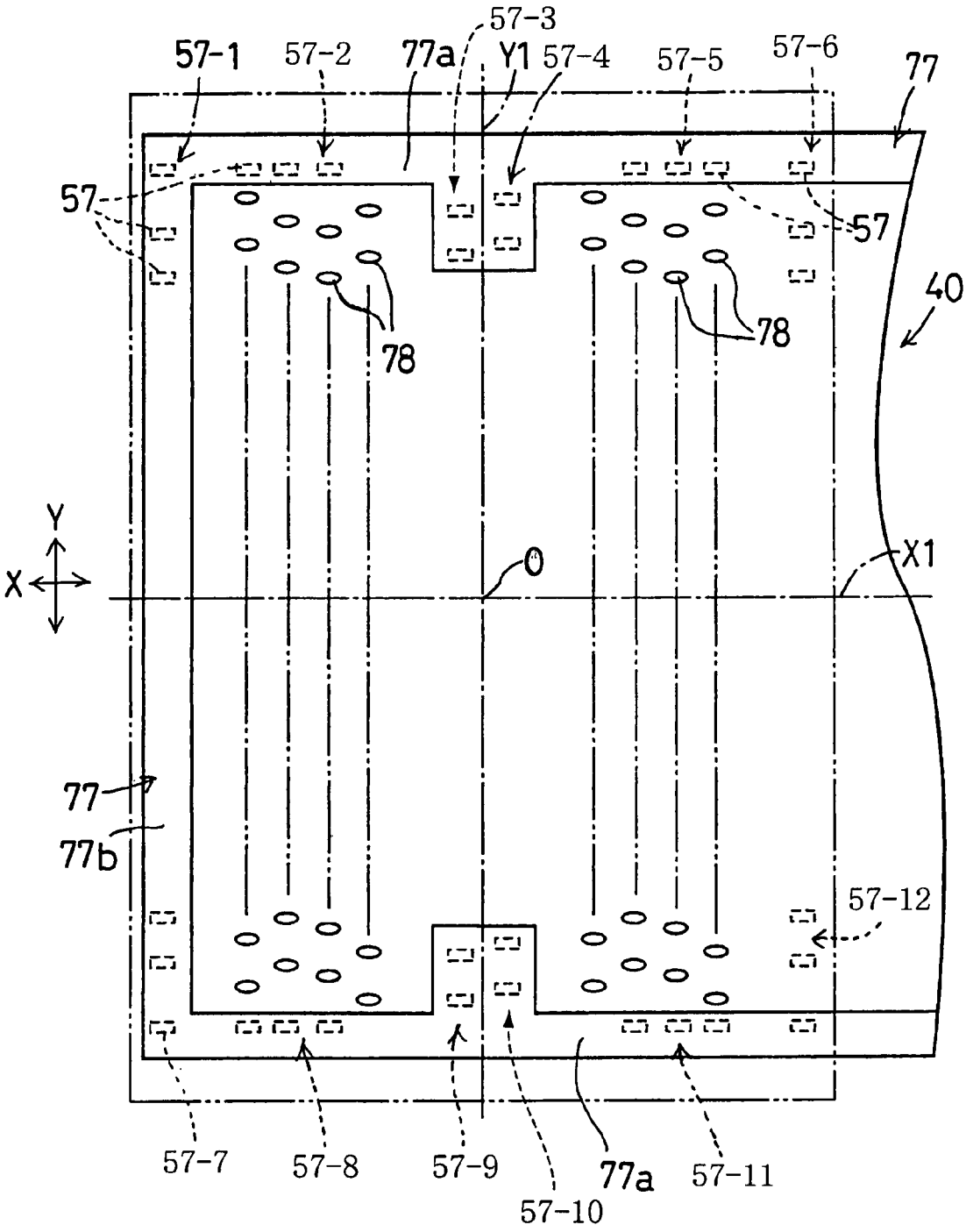
FIG. 20 is an enlarged, plan view showing a state in which one of the two flexible flat cable is stacked on he top sheet of a corresponding one of the two piezoelectric actuators.

Additionally, as shown in FIGS. 17 and 20, on the upper surface of the top sheet 35 of each piezoelectric actuator 12*a*, 12*b*, there are provided four arrays of island-like individual surface electrodes (i.e., first individual electrode connection pads) 58 and a plurality of island-like common surface electrodes (i.e., first common electrode connection pads) 57 all of which are rectangular in their plan view and function as after-attached electrodes for being connected to a common connection electrode 77 and four arrays of individual connection electrodes 78 of a corresponding one of the two flexible flat cables 40, 40. As shown in FIG. 19, each of the individual surface electrodes 58 only partly overlaps, in its plan view, an appropriate lengthwise portion of a corresponding one of the individual conductive members 52 (52-1, 52-2, 52-3, 52-4) provided on the top sheet 35, and is thus electrically connected to the corresponding conductive member 52, and the individual surface electrodes 58 of each of the four arrays are arranged in a zigzag or staggered manner in the Y direction, such that each pair of electrodes 58 located adjacent each other in the Y direction are distant from each other in the X direction.

That is, in the embodiment shown in FIG. 19, each of the individual surface electrodes 58 is provided, in its plan view, at a position offset from the corresponding pressure chamber 23 or the corresponding active portion, by substantially half the regular pitch P at which the pressure chambers 23 of each array or the active portions of each array are arranged in the Y direction, and simultaneously at a position right above the corresponding partition wall 24 between each pair of pressure chambers 23 located adjacent each other in the Y direction. The individual surface electrodes 58 of each array are arranged at the same pitch as the pitch P at which the pressure chambers 23 of each array are arranged in the Y direction.

In a modified form of the present embodiment, each of the individual surface electrodes 58 may be provided at a position that is offset from the corresponding pressure chamber 23 or the corresponding active portion, by one and half the pitch P (i.e., 1.5 P) in the Y direction, and is right above another partition wall 24.

Moreover, as shown in FIGS. 7 and 19, each of the four arrays of individual surface electrodes 58 of each of the two piezoelectric actuators 12*a*, 12*b* includes one electrode 58 that is the nearest to a corresponding one of the respective ends 44, 45 of the same 12*a*, 12*b* that are opposed to each other in the Y direction. In the present embodiment, a distance, L5, between the respective nearest electrodes 58 of the four arrays of electrodes 58 of each piezoelectric actuator 12*a*, 12*b* and the corresponding one end 44, 45 is greater than the distance L1 between the pressure chambers 23 or active portions corresponding to the nearest electrodes 58, and the corresponding end 44, 45.

As shown in FIGS. 8 and 12, the lower binder sheet 46 has the four arrays of internal connection electrodes 90 that electrically connect, in the vertical direction, between the four arrays of first individual connection members 53-1, 53-2, 53-3, 53-4 provided on the sheet 46, and the four arrays of dummy individual electrodes 38-1, 38-2, 38-3, 38-4 provided in the piezoelectric sheets 34 underlying the binder sheet 46. The internal connection electrodes 90 are formed of an electrically conductive material (paste) filling respective through-holes formed through the thickness of the sheet 46.

In addition, as shown in FIG. 12, the lower binder sheet 46 has a plurality of internal connection electrodes 91 that electrically connect, in the vertical direction, between the common connection members 54 provided on the sheet 46 and the proper common electrode 37 provided on the piezoelectric sheet 34 underlying the binder sheet 46. The internal connection electrodes 91 are formed of an electrically conductive material filling respective through-holes formed through the thickness of the sheet 46.

Likewise, as shown in FIG. 13, the upper binder sheet 47 has four arrays of internal connection electrodes 92 that electrically connect between the four arrays of second individual connection members 56-1, 56-2, 56-3, 56-4 provided on the sheet 47, and the four arrays of first individual connection members 53-1, 53-2, 53-3, 53-4 provided on the lower binder sheet 46, respectively; and additionally has a plurality of internal connection electrodes 93 that electrically connect between the common connection member 55 provided on the sheet 47 and the common connection members 54 provided on the lower binder sheet 46. The internal connection electrodes 92, 93 are formed of an electrically conductive material filling respective through-holes formed through the thickness of the upper binder sheet 47.

Also likewise, as shown in FIG. 16, the top sheet 35 has four arrays of internal connection electrodes 94 that electrically connect between the four arrays of individual conductive members 52-1, 52-2, 52-3, 52-4 provided on the sheet 35, and the four arrays of second individual connection electrodes 56-1, 56-2, 56-3, 56-4 provided on the upper binder sheet 47, respectively; and additionally has a plurality of internal connection electrodes 95 that electrically connect between the common conductive members 51 provided on the sheet 35 and the common connection member 55 provided on the upper binder sheet 47. The internal connection electrodes 94, 95 are formed of an electrically conductive material filling respective through-holes formed through the thickness of the top sheet 35.

In the present embodiment, the plurality of groups of internal connection electrodes 42*a*, 42*b*, 90, 92, 94 that connect, in the vertical direction, between the dummy individual electrodes 38 and the proper individual electrodes 36, between the proper individual electrodes 36 and the dummy individual electrodes 38, between the dummy individual electrodes 38 and the first individual connection members 53, and between the first individual connection members 53 and the second individual connection members 56, respectively, are provided such that each of the internal connection electrodes of one group 42*a*, 42*b*, 90, 92, 94 is not aligned, in its plan view, with a corresponding one of the internal connection electrodes of another group located vertically adjacent the one group.

After the common conductive members 51 are formed on the stop sheet 35, the island-like common surface electrodes 57 are attached to the top sheet 35, such that each of the common surface electrodes 57 overlaps, in its plan view, a portion of a corresponding one of the common conductive members 51, as shown in FIG. 16. The "after-attaching" of the common surface electrodes 57 and the individual surface electrodes 58 are carried out, by screen printing, using an electrically conductive material such as a silver-palladium-based paste.

In FIG. 17, the common surface electrodes 57 are represented by black rectangles, and the individual surface electrodes 58 are represented by white rectangles. On the upper surface of the top sheet 35, the common surface electrodes 57 are located at respective positions which are symmetric with each other with respect to a center, O, of the rectangular, upper surface of the top sheet 35; and similarly the individual surface electrodes 58 are located at respective positions which are symmetric with each other with respect to the center O. The center O is a first reference point on the upper surface of the top sheet 35. In FIG. 17, the number of the individual surface electrodes 58 represented by the white rectangles is smaller than the actual number of the same 58 employed by each piezoelectric actuator 12*a*, 12*b*.

On the lower surface of each of the two flexible flat cables 40, the common connection electrode 77 and the individual connection electrodes 78 are located such that when the each flexible flat cable 40 is rotated by 180 degrees about a second reference point corresponding to the center O of the upper surface of the stop sheet 35, on a horizontal plane, the common connection electrode 77 is electrically connected to the common surface electrodes 57 and the individual connection electrodes 78 are electrically connected to the individual surface electrodes 58, respectively, as shown in FIG. 20.

More specifically described, the common surface electrodes 57 include a plurality of groups of electrodes which are located, along an outer periphery of the upper surface of the top sheet 35, at appropriate intervals of distance in the first (or Y) direction and the second (or X) direction. As shown in FIG. 17, the common surface electrodes 57 include a first, a sixth, a seventh, and an twelfth group of electrodes 57-1, 57-6, 57-7, 57-12 which are located along the two opposite long sides of the top sheet 35, such that the first and seventh groups of electrodes 57-1, 57-7 are opposite to each other, and the sixth and twelfth groups of electrodes 57-6, 57-12 are opposite to each other, in the first (or Y) direction; a third, a fourth, a ninth, and a tenth group of electrodes 57-3, 57-4, 57-9, 57-10 which are located on either side of an axis line, Y1, passing through the center (i.e., the first reference point) O and extending parallel to the first (or Y) direction, such that the third and ninth groups of electrodes 57-3, 57-9 are opposite to each other, and the fourth and tenth groups of electrodes 57-4, 57-10 are opposite to each other in the first (or Y) direction; and a second, a fifth, an eighth, and an eleventh groups of electrodes 57-2, 57-5, 57-8, 57-11 which are located on along the two opposite short sides of the top sheet 35, such that the second and eighth groups of electrodes 57-2, 57-8 are opposite to each other, and the fifth and eleventh groups of electrodes 57-5, 57-11 are opposite to each other in the first (or Y) direction. The second and eighth groups of electrodes 57-2, 57-8 are located between the first and seventh groups of electrodes 57-1, 57-7 and the third and ninth groups of electrodes 57-3, 57-9, and the fifth and eleventh groups of electrodes 57-2, 57-8 are located between the fourth and tenth groups of electrodes 57-4, 57-10 and the sixth and twelfth groups of electrodes 57-6, 57-12. The first and seventh groups of electrodes 57-1, 57-7 are located on either side of an axis line, X1, passing through the center O and extending parallel to the second (or X) direction; and likewise, the second and the eighth groups of electrodes 57-2, 57-8, the third and the ninth groups of electrodes 57-3, 57-9, the fourth and tenth groups of electrodes 57-4, 57-10, the fifth and eleventh groups of electrodes 57-5, 57-11, and the sixth and twelfth groups of electrodes 57-6, 57-12 are located on either side of the axis line X1. The electrodes 57-1 of the first group are located at the respective positions which are symmetric, with respect to the center O, with the respective positions where the electrodes 57-12 of the twelfth group are located; the electrodes 57-2 of the second group are located at the respective positions which are symmetric, with respect to the center O, with the respective positions where the electrodes 57-11 of the eleventh group are located; and the electrodes 57-3 of the third group are located at the respective positions which are symmetric, with respect to the center O, with the respective positions where the electrodes 57-10 of the tenth group are located. In addition, the electrodes 57-4 of the fourth group are located at the respective positions which are symmetric, with respect to the center O, with the respective positions where the electrodes 57-9 of the ninth group are located; the electrodes 57-5 of the fifth group are located at the respective positions which are symmetric, with respect to the center O, with the respective positions where the electrodes 57-8 of the eighth group are located; and the electrodes 57-6 of the sixth group are located at the respective positions which are symmetric, with respect to the center O, with the respective positions where the electrodes 57-7 of the seventh group are located. Similarly, the individual surface electrodes 58 are located, on the upper surface of an inner portion of the top sheet 35, at the respective positions which are symmetric with each other with respect to the center O.

On the lower surface of each flexible flat cable 40, there are provided the common connection electrode 77 to be connected to the common surface electrodes 57, and the individual connection electrodes 78 to be connected to the individual surface electrodes 58, respectively. As shown in FIG. 20, the common connection electrode 77 has a belt-like shape and includes two first portions 77*a*, 77*a* which are respectively provided along two opposite side edges of the each cable 40 in the second (or X) direction, and a second portion 77*b* which is provided along a free end edge of the each cable 40 and connects between respective one ends of the two first portions 77*a*, 77*a*. The individual connection electrodes 78 are located in an area surrounded by the first and second portions 77*a*, 77*a*, 77*b* of the common connection electrode 77, such that the individual connection electrodes 78 correspond to the individual surface electrodes 58, respectively. Each flexible flat cable 40 includes a plurality of thin lead wires, not shown, which extend in the second (or X) direction and which are connected, at respective one ends thereof, to the individual connection electrodes 78 and, at respective other ends thereof, to a drive IC (integrated circuit) 40*a* which is attached, as shown in FIG. 2, to one surface of the each cable 40. Respective other ends of the two first portions 77*a*, 77*a* of the common connection electrode 77 also functioning as a lead wire are connected to the driver IC 40*a*.

In the case where each of the two flexible flat cables 40 is connected to the top sheet 35 of a corresponding one of the two piezoelectric actuators 12*a*, 12*b*, in one direction with respect to the long sides of the printer head 6, indicated by two-dot chain lines in FIG. 4 and indicated by solid lines in FIG. 20, the second portion 77*b* of the common connection electrode 77 is connected to the first and seventh groups of common surface electrodes 57-1 57-12, and the two first portions 77*a*, 77*a* of the same 77 are connected to at least the third, fourth, fifth, ninth, tenth, and eleventh sixth groups of common surface electrodes 57-3, 57-4, 57-5, 57-9, 57-10, 57-11. The two first portions 77*a*, 77*a* may be additionally connected to the second and eighth groups of common surface electrodes 57-2, 57-8, and/or the sixth and twelfth groups of common surface electrodes 57-6, 57-12.

On the other hand, in the case where each of the two flexible flat cables 40 is connected to the top sheet 35 of the corresponding piezoelectric actuator 12*a*, 12*b*, in the opposite direction with respect to the long sides of the printer head 6, indicated by solid lines in FIG. 4, the second portion 77*b* of the common connection electrode 77 is connected to the sixth and twelfth groups of common surface electrodes 57-6, 57-12, and the two first portions 77*a*, 77*a* of the same 77 are connected to at least the second, third, fourth, eighth, ninth, and tenth groups of common surface electrodes 57-2, 57-3, 57-4, 57-8, 57-9, 57-10. The two first portions 77*a*, 77*a* may be additionally connected to the fifth and eleventh groups of common surface electrodes 57-5, 57-11 and/or the first and seventh groups of common surface electrodes 57-1, 57-7.

Each of the two flexible flat cables 40 as the wiring substrates has a known structure, that is, includes the above-described thin lead wires each of which is constituted by, e.g., a copper foil, and an electrically insulating synthetic resin which has flexibility and resistance to curving or deforming and which supports the lead wires such that the common connection electrode 77 and the individual connection electrodes 78 are exposed through respective holes 64 (FIG. 23) in the lower surface of the each cable 40, and are contacted with respective connection bumps 63. In the case where those connection bumps 63 are solder bumps, the solder bumps 63 are provided on the common surface electrodes 57 and the individual surface electrodes 58, and are bonded to the same 57, 58 by heating and pressing. Alternatively, in the case where those connection bumps 63 are formed of an anisotropic electrically conductive resin that obtains electric conductivity when being pressed, the connection bumps 63 are bonded, by just pressing, to the electrodes 57, 58. The common connection electrode 77, the individual connection electrodes 78, and the thin lead wires (not shown) extending from the electrodes 78 are covered with an electrically insulating protective layer, not shown.

As is apparent from the foregoing description of the first embodiment of the present invention, the common surface electrodes 57 and the individual surface electrodes 58 are provided on one major surface of the top sheet 35 of each of the two piezoelectric actuators 12*a*, 12*b*, such that the common surface electrodes 57 are symmetric with each other, and the individual surface electrodes 58 are symmetric with each other, both with respect to the center O of the major surface; and the common connection electrode 77 and the individual connection electrodes 78 are provided in each of the two flexible flat cables 40, such that even when the each cable 40 may be rotated by 180 degrees about the second reference point corresponding to the center O as the first reference point, the common connection electrode 77 can be electrically connected to the common surface electrodes 57 and the individual connection electrodes 78 can be electrically connected to the individual surface electrodes 58, respectively. Therefore, two identical flexible flat cables 40 can be easily connected to two identical printer heads 6, from two opposite directions, respectively, that differ from each other by 180 degrees. In this case, if the second portion 77*b* of the common connection electrode 77, provided along the free end portion of each flexible flat cable 40 and extending in the first or Y direction, is bonded to the first and seventh groups (or the sixth and twelfth groups) of common surface electrodes 57-1, 57-7 (or 57-6, 57-12) of the corresponding piezoelectric actuator 12*a*, 12*b*, a lengthwise intermediate portion of the common connection electrode 77 that is remote from the second portion 77*b* in the second or X direction is not bonded to any of the common surface electrodes 57. Therefore, even if each flexible flat cable 40 may expand or shrink in the X direction because of, e.g., temperature changes, the bonding of the second portion 77*b* to the corresponding piezoelectric actuator 12*a*, 12*b* can be maintained with improved reliability. In addition, another lengthwise intermediate portion of each flexible flat cable 40 can be easily curved to pass through the slit 87 of the head holder 1, as shown in FIGS. 2 and 3.

Moreover, since the first portions 77*a*, 77*a* of the common connection electrode 77 and the second, fifth, eighth, and eleventh groups of common surface electrodes 57-2, 57-5, 57-8, 57-11 are elongate in the second or X direction, the bonding of the first portions 77*a*, 77*a* and those groups of electrodes 57-2, 57-5, 57-8, 57-11 can be maintained with improved reliability, even if each flexible flat cable 40 may expand or shrink in the second or X direction.

Furthermore, since the first portions 77*a*, 77*a* of the common connection electrode 77 are formed within the widthwise or Y-direction dimension of each flexible flat cable 40, the each cable 40 and accordingly the printer head 6 can enjoy a compact structure.

The third, fourth, ninth, and tenth groups of common surface electrodes 57-3, 57-4, 57-9, 57-10 are provided between two groups of island-like individual surface electrodes 58 provided on either side of the axis line Y1 on one major surface of the top sheet 35, such that those electrodes 57-3, 57-4, 57-9, 57-10 are located in an inner area of the top sheet 35 in the first direction. Thus, the major surface of the top sheet 35 can be effectively utilized.

In the first embodiment, the widthwise direction of each flexible flat cable 40 to be bonded to the corresponding piezoelectric actuator 12*a*, 12*b* is parallel to the lengthwise direction of the top sheet 35 or the piezoelectric actuator 12*a*, 12*b*. Therefore, the individual connection electrodes 78 and the thin lead wires, not shown, that are connected to the large number of proper individual electrodes 36 arranged in the arrays in the lengthwise direction of the actuator 12*a*, 12*b* can be located in an increased area and accordingly the degree of freedom of designing of the individual connection electrodes 78 and the lead wires is increased.

In the first embodiment, the plurality of groups of common surface electrode pads (i.e., first common electrode connection pads) 57-1 through 57-12 of the piezoelectric actuator 12 are bonded to the common connection electrode (i.e., second common electrode connection pad) 77 of the flexible flat cable (i.e., wiring substrate) 40, and accordingly the piezoelectric actuator 12 can be more strongly bonded to the flat cable 40. Therefore, even if the flat cable 40 may expand or shrink in the first or second direction because of, e.g., temperature changes, the bonding of the flat cable 40 to the piezoelectric actuator 12 can be maintained with improved reliability. In addition, since the individual surface electrode pads (i.e., first individual electrode connection pads) 58 are located in the inner area of the outer, major surface of the top sheet (i.e., outermost sheet member) 35, the large number of individual connection electrodes (i.e., second individual electrode connection pads) 78 corresponding to the individual surface electrode pads 58, and the lead wires (i.e., individual wirings), not shown, connected to the individual connection electrodes 78 can be located in a large area of the outer surface of the flat cable 40. The individual wirings may be identical with the lead wires (i.e., individual wirings) 179*a* shown in FIG. 22.

In the first embodiment, the widthwise direction of the flexible flat cable 40 fixed to the piezoelectric actuator 12 is parallel to the first direction, i.e., the lengthwise direction of the top sheet 35 or the piezoelectric actuator 12, and accordingly the flat cable 40 can have a large dimension. Therefore, the individual connection electrodes 78 and the lead wires that are connected to the internal individual electrodes 36 arranged in the lengthwise direction of the actuator 12 can be located in a large area and accordingly the degree of freedom of designing of the individual connection electrodes 78 and the lead wires is increased.

In the first embodiment, the common connection electrode 77 of the flexible flat cable 40 extends in both the first and second directions. Accordingly, the piezoelectric actuator 12 and the flat cable 40 can be bonded with each other via an increased bonding area and accordingly with an increased bonding strength.

Figure 21:
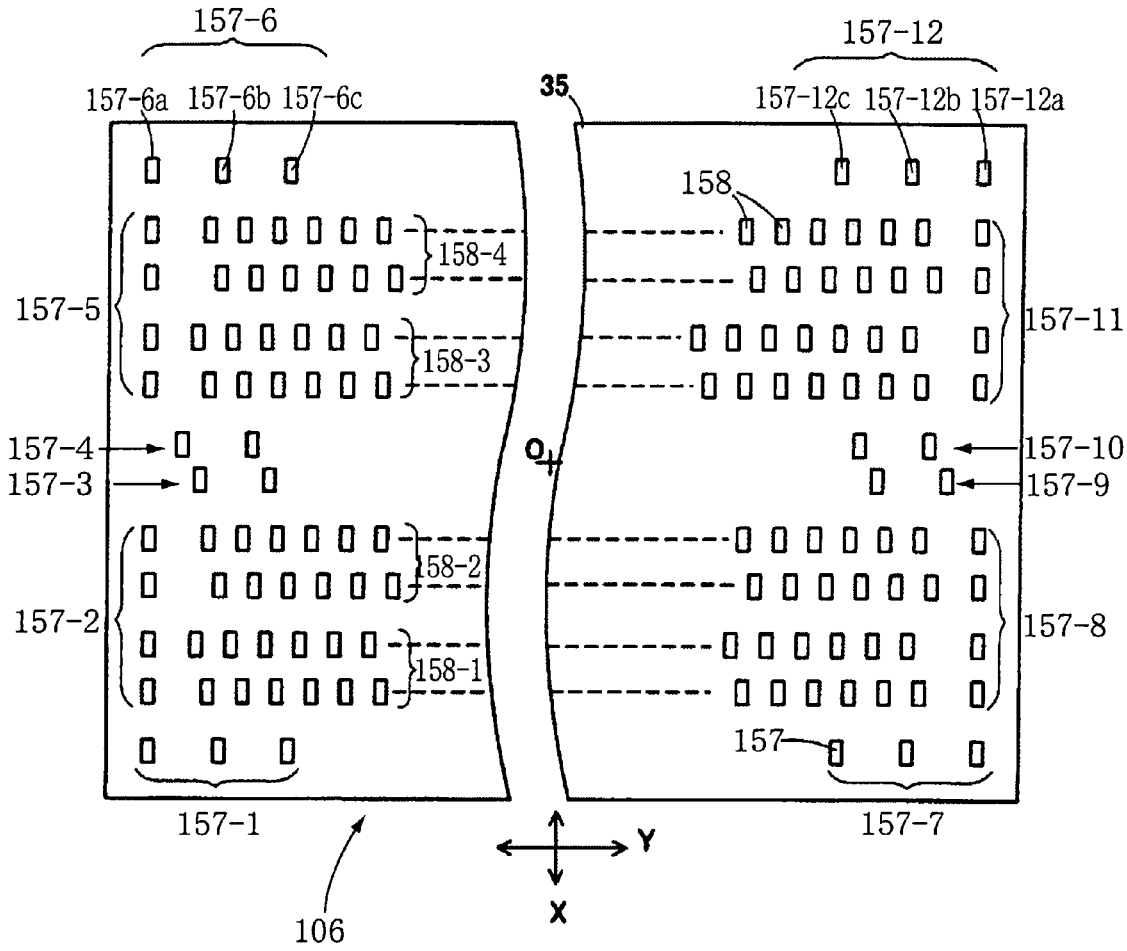
FIG. 21 is an enlarged, plan view corresponding to FIG. 17, showing a top sheet of one of two piezoelectric actuators of another ink jet printer head as another embodiment of the present invention, showing individual and common surface electrodes, a portion of the top sheet being cut away.

Next, there will be described a second embodiment of the present invention by reference to FIGS. 21, 22, and 23. The second embodiment relates to an ink jet printer head 106 which may be employed, by the ink jet printer 100, in place of the ink jet printer head 6. Like the printer head 6 shown in FIG. 2, the printer head 106 has, in its plan view, a rectangular shape which is elongate in the Y direction and is short in the X direction. The same reference numerals as used in the first embodiment shown in FIGS. 1 through 5, 6A, 6B, 7 through 20, and 23 are used to designate the corresponding elements of the second embodiment shown in FIGS. 21, 22, and 23 and the description of those elements is omitted. The following description relates to only the differences of the first and second embodiments.

The ink jet printer head 106 employs, in place of the common and individual surface electrodes 57, 58 shown in FIG. 17, a plurality of common surface electrodes (i.e., first common electrode connection pads) 157 and a plurality of individual surface electrodes (i.e., first individual electrode connection pads) 158 all of which are provided on an upper surface of a top sheet 35 as an outermost sheet of each of two piezoelectric actuators 12*a*, 12*b* to which two flexible flat cables 40, 40 are bonded, respectively.

The individual surface electrodes 158 include a first array of individual surface electrodes 158-1 corresponding to the first array of pressure chambers 23-1; a second array of individual surface electrodes 158-2 corresponding to the second array of pressure chambers 23-2; a third array of individual surface electrodes 158-3 corresponding to the third array of pressure chambers 23-3; and a fourth array of individual surface electrodes 158-4 corresponding to the fourth array of pressure chambers 23-4. Each array of individual surface electrodes 158-1, 158-2, 158-3, 158-4 are arranged in a zigzag or staggered fashion in the Y direction. A space is provided between the second and third arrays of electrodes 158-2, 158-3.

The common surface electrodes 157 include a plurality of groups of common surface electrodes, i.e., at least one group of common surface electrodes 157-1, 157-3, 157-4, 157-6, 157-7, 157-9, 157-10, 157-12 arranged in the Y direction, and at least one group of common surface electrodes 157-2, 157-5, 157-8, 157-11 arranged in the X direction. More specifically described, the common surface electrodes 157 include a first and a seventh group of common surface electrodes 157-1, 157-7 which are arranged in one array along one of the opposite long sides of the top sheet 35 in the Y direction and are distant from, and parallel to, the first array of individual surface electrodes 158-1; a sixth and a twelfth group of common surface electrodes 157-6, 157-12 which are arranged in one array along the other long side of the top sheet 35 in the Y direction and are distant from, and parallel to, the fourth array of individual surface electrodes 158-4; a third and a ninth group of common surface electrodes 157-3, 157-9 which are arranged in one array along the second array of individual surface electrodes 158-2, and are parallel to the same 158-2; a fourth and a tenth group of common surface electrodes 157-4, 157-10 which are arranged in one array along the third array of individual surface electrodes 158-3, and are parallel to the same 158-3; a second and an eighth group of common surface electrodes 157-2, 157-8 which are located on either side of the first and second arrays of individual surface electrodes 158-1, 158-2 in the Y direction and are arranged in two arrays along the opposite short sides of the top sheet 35, respectively, in the X direction; and a fifth and an eleventh group of common surface electrodes 157-5, 157-11 which are located on either side of the third and fourth arrays of individual surface electrodes 158-3, 158-4 in the Y direction and are arranged in two arrays along the opposite short sides of the top sheet 35, respectively, in the X direction. Each group of common surface electrodes 157-1 through 157-12 includes a plurality of common surface electrodes 157. The common surface electrodes of each of the first, third, fourth, sixth, seventh, ninth, tenth, and twelfth groups 157-1, 157-3, 157-4, 157-6, 157-7, 157-9, 157-10, 157-12 of each of the two piezoelectric actuators 12*a*, 12*b* are located in only respective vicinities of the opposite short sides of the top sheet 35, for the purpose of preventing those common surface electrodes 157 from interfering with respective lead wires 179*a* connected to a plurality of individual connection electrodes (i.e., second individual electrode connection pads) 178 of a corresponding one of the two flexible flat cables 40.

Figure 22:
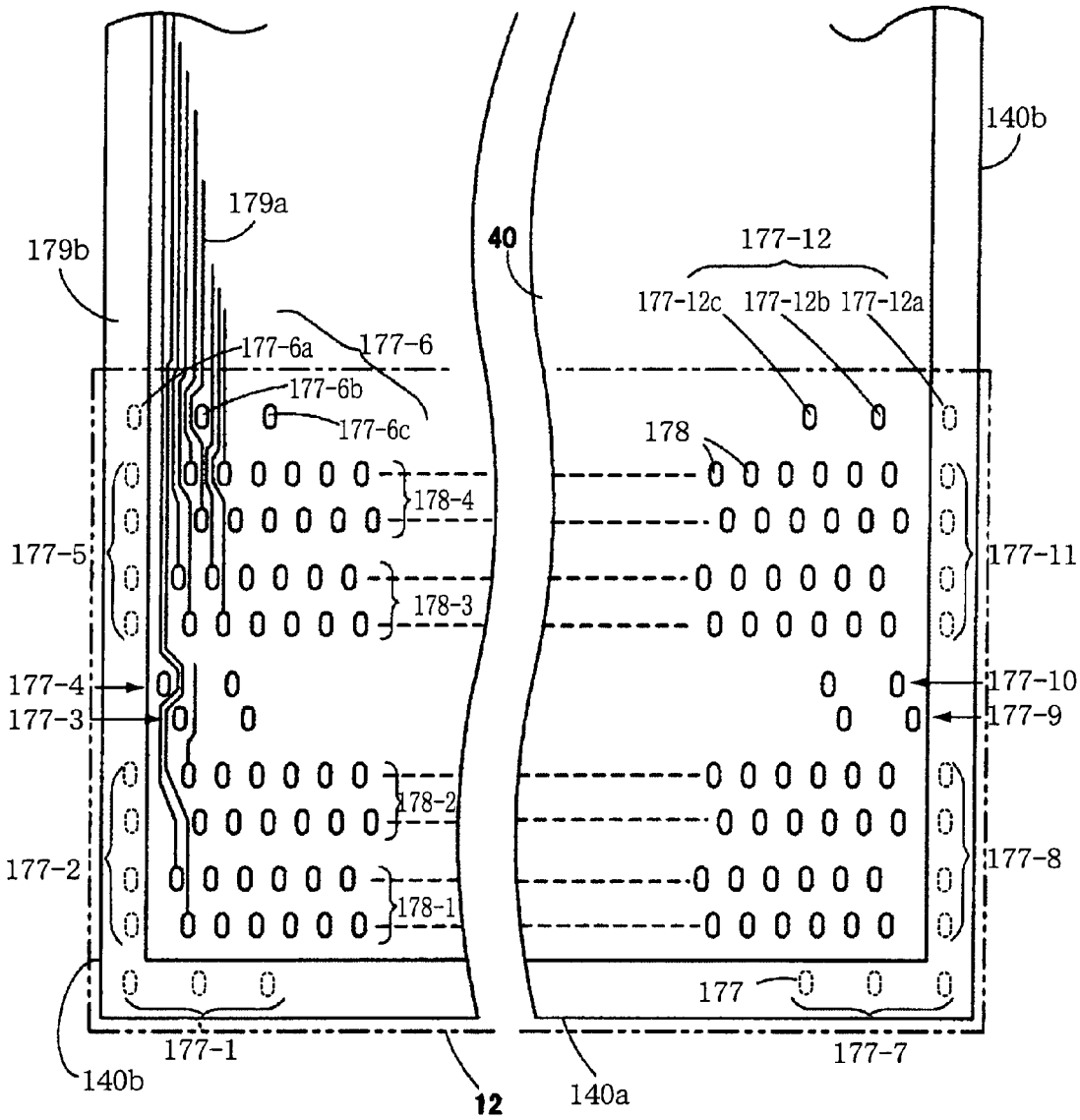
FIG. 22 is an enlarged, plan view of one of two flexible flat cables of the ink jet printer head of FIG. 21, showing individual and common connection electrodes, a portion of the flexible flat cable being cut away.

Meanwhile, as shown in FIG. 22, each of the two flexible flat cables 40 that is to be stacked on the top sheet 135 of a corresponding one of the two piezoelectric actuators 12*a*, 12*b* has, in a lower, major surface thereof, a plurality of common connection electrodes (i.e., second common electrode connection pads) 177 which are to be connected to the common surface electrodes 157, respectively; and the individual connection electrodes 178 which are to be connected to the individual surface electrodes 158, respectively. The common connection electrodes 177 and the individual connection electrodes 178 are formed at respective positions which assure that the common connection electrodes 177 can be electrically connected to the common surface electrodes 157, respectively, and the individual connection electrodes 178 can be connected to the individual surface electrodes 158, respectively.

Each flexible flat cable 40 extends outward from the upper surface of the top sheet 35 of the corresponding piezoelectric actuator 12*a*, 12*b*, in a direction perpendicular to the direction in which the individual surface electrodes 158 are arranged in the arrays. The flexible flat cable 40 has a common lead wire or common wiring 179*b* which extends along a free end portion 140*a* of the cable 40 (i.e., along one of the two long side portions of the top sheet 35), and along two side portions 140*b*, 140*b* of the cable 40 that extend in the direction in which the cable 40 extends outward from the top sheet 35. In addition, the flat cable 40 has a plurality of individual lead wires or individual wirings 179*a* which extend from the individual connection electrodes 178, such that each of the individual wirings 179*a* runs through free areas left among the individual connection electrodes 178 and does not cross the other individual wirings 179*a*. The individual wirings 179*a* and the common wiring 179*b* are connected to the drive circuit 40*a* (FIG. 2) which is provided to the other end portion of the flat cable 40.

The common wiring 179*b* has a width that is sufficiently greater than that of each of the individual wirings 179*a*, and contains a first and a seventh group of common connection electrodes 177-1, 177-7, a second and an eighth group of common connection electrodes 177-2, 177-8, and a fifth and an eleventh group of common connection electrodes 177-5, 177-11 that correspond to the first and seventh groups of common surface electrodes 157-1, 157-7, the second and eighth groups of common surface electrodes 157-2, 157-8, and the fifth and eleventh groups of common surface electrodes 157-5, 157-11, respectively, that are provided on the top sheet 35. In addition, the width of the common wiring 179*b* contains two common connection electrodes 177-6*a*, 177-12*a* corresponding to the respective outermost electrodes 157-6*a*, 157-12*a* of the sixth and twelfth groups of common surface electrodes 157-6, 157-12. The common connection electrodes 177-1, 177-2, 177-5, 177-6*a*, 177-7, 177-8, 177-11, 177-12*a* contained by the width of the common wiring 179*b* are respective integral portions of the same 179*b*, and are exposed in the lower surface of the flat cable 40.

Four inner electrodes 157-6*b*, 157-6*c*, 157-12*b*, 157-12*c* of the sixth and twelfth groups of common surface electrodes 157-6, 157-12, and the third, fourth, ninth, and tenth groups of common surface electrodes 157-3, 157-4, 157-9, 157-10 have no wirings extending therefrom. Thus, those surface electrodes 157-6*b*, 157-6*c*, 157-12*b*, 157-12*c*, 157-3, 157-4, 157-9, 157-10 can be called as "dummy" surface electrodes. Since those surface electrodes 157-6*b*, 157-6*c*, 157-12*b*, 157-12*c*, 157-3, 157-4, 157-9, 157-10 are located at respective positions nearer to the drive circuit 40*a* than the respective positions where at least half of the individual connection electrodes 178 are located, those surface electrodes 157 can be located in areas free of the individual wirings 179*a* extending from the individual connection electrodes 178.

Figure 23:
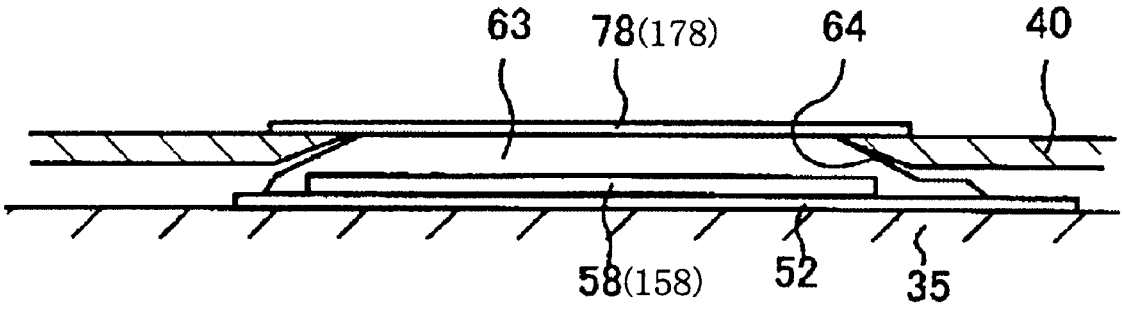
FIG. 23 is an enlarged, cross-sectional view of a bonded portion where an individual surface electrode provided on the top sheet and an individual connection electrode provided on the flexible flat cable are bonded to each other.

Each surface electrode 157, 158 provided on the top sheet 35 of each piezoelectric actuator 12*a*, 12*b* and each connection electrode 177, 178 provided on each flexible flat cable 40 are bonded to each other, in the same manner as shown in FIG. 23. More specifically described, each flexible flat cable 40 is constituted by a flexible insulting insulating film formed of, e.g., polyimide, the connection electrodes 177, 178, and the wirings 179*a*, 179*b*. The insulting film has, at respective positions corresponding to the individual connection electrodes 178, respective holes 64 that are formed, e.g., by etching or by using laser, and a brazing filler metal such as conductive solder 63 is applied to the individual connection electrodes 178 located at respective bottoms of the holes 64. The individual connection electrodes 178 are placed on the individual surface electrodes 158, respectively, and are pressed against the same 158, respectively, while being heated. Thus, the electrodes 178 are electrically and mechanically bonded to the electrodes 158, respectively. The common surface electrodes 157 and the common connection electrodes 177 are bonded to each other in the same manner. The electrodes 177, 178 are simultaneously bonded to the electrodes 157, 158, respectively.

The common connection electrodes 177-6*b*, 177-6*c*, 177-12*b*, 177-12*c*, 177-3, 177-4, 177-9, 177-10 from which no wirings extend are bonded to the common surface electrodes 157-6*b*, 157-6*c*, 157-12*b*, 157-12*c* of the sixth and twelfth groups, and the common surface electrodes 157-3, 157-4, 157-9, 157-10 of the third, fourth, ninth, and tenth groups, respectively. However, those connection electrodes 177-6*b*, 177-6*c*, 177-12*b*, 177-12*c*, 177-3, 177-4, 177-9, 177-10 do not function as either individual or common connection electrodes, but function as connection portions or pads, and accordingly can be called as "dummy" connection electrodes. The dummy connection electrodes 177-6*b*, 177-6*c*, 177-12*b*, 177-12*c*, 177-3, 177-4, 177-9, 177-10 are bonded to the dummy surface electrodes 157-6*b*, 157-6*c*, 157-12*b*, 157-12*c*, 157-3, 157-4, 157-9, 157-10, respectively, at respective positions arranged in arrays that are distant from, and parallel to, the arrays of the individual connection electrodes 178 and the arrays of individual surface electrodes 158 that are bonded to each other. Therefore, stresses produced by the expansion and shrinkage of each flexible flat cable 40 and the corresponding piezoelectric actuator 12*a*, 12*b*, because of the difference of respective linear expansions thereof, can be effectively prevented from being exerted to the respective bonded portions of the individual connection electrodes 178 and the individual surface electrodes 158. Likewise, the common connection electrodes 177-1, 177-7 of the first and seventh groups are bonded to the common surface electrodes 157-1, 157-7 of the first and seventh groups, respectively, at respective positions arranged in an array parallel to the arrays of the individual connection and surface electrodes 178, 158 bonded to each other. Thus, those connection electrodes 177-1, 177-7 function like the dummy connection electrodes 177-6*b*, 177-6*c*, 177-12*b*, 177-12*c*, 177-3, 177-4, 177-9, 177-10, and additionally function as the proper common connection electrodes. The dummy common surface electrodes 157-6*b*, 157-6*c*, 157-12*b*, 157-12*c*, 157-3, 157-4, 157-9, 157-10 and the other, proper common surface electrodes 157-1, 157-2, 157-5, 157-6*a*, 157-7, 157-8, 157-11, 157-12*a* cooperate with each other to provide a plurality of first redundant connection pads; and the dummy common connection electrodes 177-6*b*, 177-6*c*, 177-12*b*, 177-12*c*, 177-3, 177-4, 177-9, 177-10 and the other, proper common surface electrodes 177-1, 177-2, 177-5, 177-6*a*, 177-7, 177-8, 177-11, 177-12*a* cooperate with each other to provide a plurality of second redundant connection pads.

Thus, when each flexible flat cable 40 is extended upward from one side portion of the upper surface of the corresponding piezoelectric actuator 12*a*, 12*b* and is passed through the slit 87 while being flexed, stresses can be effectively prevented from being exerted to the respective bonded portions of the individual connection electrodes 178 and the individual surface electrodes 158.

The more the dummy connection electrodes 177-6*b*, 177-6*c*, 177-12*b*, 177-12*c*, 177-3, 177-4, 177-9, 177-10 arranged in the arrays parallel to the arrays of individual connection electrodes 178 are, the less the above-indicated stresses are. In the present embodiment, however, the dummy common connection electrodes 177-2*b*, 177-2*c*, 177-12*b*, 177-12*c*, 177-3, 177-4, 177-9, 177-104 are located in only the respective vicinities of the respective end portions of the arrays of individual connection electrodes 178, so that the individual wirings 179*a* connected to the individual connection electrodes 178 are not interfered with by those dummy common connection electrodes.

The common surface electrodes 157-6*b*, 157-6*c*, 157-12*b*, 157-12*c* of the sixth and twelfth groups, and the common surface electrodes 157-3, 157-4, 157-9, 157-10 of the third, fourth, ninth, and tenth groups, all of which are provided on the top sheet 35 of each piezoelectric actuator 12*a*, 12*b*, may, or may not, be electrically connected to the proper common internal electrodes 37 of the each piezoelectric actuator 12*a*, 12*b*. Meanwhile, as shown in FIG. 21, the individual surface electrodes 158 and the common surface electrodes 157 are located, on the top sheet 35 of each piezoelectric actuator 12*a*, 12*b*, such that the individual surface electrodes 158 are point-symmetric with each other with respect to the center O of the top sheet 35 and the common surface electrodes 157 are also point-symmetric with each other with respect to the center O; and, as shown in FIG. 22, the individual connection electrodes 178 and the common connection electrodes 177 are located on each flexible flat cable 40, such that even if the each flat cable 40 is rotated by 180 degrees about the center O, the each flat cable 40 can be electrically connected to the corresponding piezoelectric actuator 12*a*, 12*b*. Thus, each flexible flat cable 40 can be connected to the corresponding piezoelectric actuator 12*a*, 12*b*, in an arbitrary one of two opposite directions perpendicular to the lengthwise direction of the each actuator 12*a*, 12*b*. Thus, the common surface electrodes 157-6*b*, 157-6*c*, 157-12*b*, 157-12*c* of the sixth and twelfth groups may be electrically connected to the common wiring 179*b*, when the each flat cable 40 is connected to the corresponding piezoelectric actuator 12*a*, 12*b*, in one of the two opposite directions.

In each of the illustrated embodiments, the nozzles 11*a* of the cavity unit 10 are arranged in the four arrays, and the active portions of each piezoelectric actuator 12*a*, 12*b* are arranged in the four arrays respectively corresponding to the four arrays of nozzles 11*a*. However, the principle of the present invention is applicable to an ink jet printer head having a plurality of ink ejection nozzles arranged in at least one array. In addition, the principle of the present invention is applicable to an ink jet printer head in which a single piezoelectric actuator and a single flexible flat cable are bonded to each other. In the second embodiment shown in FIGS. 21 through 23, the common surface electrodes 157-3, 157-4, 157-9, 157-10 of the third, fourth, ninth, and tenth groups and the common connection electrodes 177-3, 177-4, 177-9, 177-10 of the third, fourth, ninth, and tenth groups may be omitted.

In the second embodiment, since the flexible flat cable (i.e., wiring substrate) 40 is extended outward from the outer surface of the piezoelectric actuator 12, in the second direction perpendicular to the first direction in which the individual surface electrodes (i.e., first individual electrode connection pads) 158 are arranged in at least one array, the individual surface electrodes 158 and the individual connection electrodes (i.e., second individual electrode connection pads) 178 can be easily connected to each other in at least one array. Therefore, the present ink jet printer head 106 can be advantageously produced.

In the second embodiment, the individual wirings 179*a* connected to the individual connection electrodes 178 extend parallel to each other, in an inner area of the flexible flat cable 40 in the lengthwise direction thereof. Therefore, it is difficult to locate the common connection electrodes 177 in the inner area of the flat cable 40. However, it is easy to locate, in the inner area of the flat cable 40, the dummy connection electrodes 177-3, 177-4, 177-6*b*, 177-6*c*, 177-9, 177-10, 177-12*b*, 177-12*c* that do not contribute to applying the electric voltage to any of the active portions. Thus, the dummy connection electrodes can effectively prevent stresses caused by the expansion and shrinkage of the piezoelectric actuator 12 and the flat cable 40, from concentrating on the respective bonded portions of the individual surface electrodes 158 and the individual connection electrodes 178.

In the second embodiment, the respective bonded portions of the common surface electrodes 157 and the common connection electrodes 177 effectively prevent stresses caused by the expansion and shrinkage of the piezoelectric actuator 12 and the flexible flat cable 40 because of their temperature changes, from concentrating on the respective bonded portions of the individual external electrodes 158 and the individual connection electrodes 178.

In the second embodiment, the common surface electrodes 157-2, 157-8, 157-5, 157-11 located along the respective lengthwise ends of the zigzag array of individual surface electrodes 158 cooperate with the individual surface electrodes 158 of the zigzag array to apply, with reliability, the electric voltage to the active portions of the piezoelectric actuator 12. In addition, the common surface electrodes 157-1, 157-3, 157-4, 157-6, 157-7, 157-9, 157-10, 157-12 located along the straight lines parallel to the arrays of individual surface electrodes 158 can effectively prevent stresses resulting from the expansion and shrinkage of the piezoelectric actuator 12 and the flexible flat cable 40, from concentrating on the respective bonded portions of the individual surface electrodes 158 and the individual connection electrodes 178.

It is to be understood that the present invention may be embodied with other changes and improvements that may occur to a person skilled in the art, without departing from the spirit and scope of the invention defined in the claims.

What is claimed is:

1. An ink jet printer head, comprising:

a cavity unit including a plurality of ink ejection nozzles, and a plurality of pressure chambers communicating with the ink ejection nozzles, respectively;

a piezoelectric actuator including a plurality of active portions each of which is driven to change a pressure of an ink accommodated in a corresponding one of the pressure chambers, and thereby eject, from a corresponding one of the ink ejection nozzles, a droplet of the ink, the piezoelectric actuator including at least one common electrode common to the active portions, and a plurality of individual electrodes corresponding to the active portions, respectively, the cavity unit and the piezoelectric actuator being fixed to each other; and a wiring substrate having at least one common wiring, and a plurality of individual wirings each of which cooperates with said at least one common wiring to apply an electric voltage to a corresponding one of the active portions, wherein the piezoelectric actuator further includes a plurality of pairs of first common electrode connection pads and a plurality of pairs of first individual electrode connection pads which are provided on an outer surface thereof such that the two first common electrode connection pads of each of said pairs are located at respective positions symmetric with each other with respect to a first reference point on the outer surface and the two first individual electrode connection pads of each of said pairs are located at respective positions symmetric with each other with respect to the first reference point, and such that the first common electrode connection pads are electrically connected to said at least one common electrode and the first individual electrode connection pads are electrically connected to the individual electrodes, respectively, and wherein the wiring substrate further includes at least one second common electrode connection pad connected to the common wiring, and a plurality of second individual electrode connection pads which are connected to the individual wirings, respectively, and are provided at respective positions assuring that when the wiring substrate takes a first angular phase about a second reference point corresponding to the first reference point, said at least one second common electrode connection pad is electrically connected to at least one of the first common electrode connection pads and the second individual electrode connection pads are electrically connected to the first individual electrode connection pads, respectively, and when the wiring substrate takes a second angular phase differing from the first angular phase by 180 degrees about the second reference point, said at least one second common electrode connection pad is electrically connected to at least one of the first common electrode connection pads and the second individual electrode connection pads are electrically connected to the first individual electrode connection pads, respectively.

2. The ink jet printer head according to claim 1, wherein the first reference point on the outer surface of the piezoelectric actuator is a center of the outer surface.

3. The ink jet printer head according to claim 1, wherein the first common electrode connection pads are provided in a plurality of groups along an outer periphery of the outer surface of the piezoelectric actuator, wherein each of the groups includes a plurality of the first common electrode connection pads, and wherein the first individual electrode connection pads are provided in an inner area of the outer surface of the piezoelectric actuator.

4. The ink jet printer head according to claim 3, wherein the first individual electrode connection pads are arranged in at least one array in a first direction, and wherein the plurality of groups include at least one first group which is remote from said at least one array of first individual electrode connection pads in a second direction perpendicular to the first direction, and at least two first groups which are provided on either side of said at least one array of first individual electrode connection pads in the first direction.

5. The ink jet printer head according to claim 3, wherein the first individual electrode connection pads are arranged in a first direction, and wherein the plurality of groups include at least two first groups which are distant from each other in a second direction perpendicular to the first direction, and at least two second groups which are distant from each other in the first direction.

6. The ink jet printer head according to claim 1, wherein the first individual electrode connection pads are arranged in a first direction, and wherein the wiring substrate taking each of the first and second angular phases extends parallel to a second direction perpendicular the first direction.

7. The ink jet printer head according to claim 1, wherein the first individual electrode connection pads are arranged in a first direction, wherein said at least one second common electrode connection pad of the wiring substrate that is to be bonded to the first common electrode connection pads of the piezoelectric actuator includes two first elongate portions extending along two opposite side portions of the wiring substrate, respectively, in a second direction perpendicular to the first direction, and a second elongate portion connecting between the two first elongate portions and extending along a free end portion of the wiring substrate in the first direction, and wherein the second individual electrode connection pads are provided in an inner area surrounded by the first and second elongate portions of said at least one second common electrode connection pad.

8. The ink jet printer head according to claim 1, wherein the first individual electrode connection pads are arranged in at least one array, and the second individual electrode connection pads are arranged in at least one array, wherein the piezoelectric actuator includes, on the outer surface thereof, a plurality of first redundant connection pads including at least one of the first common electrode connection pads, and at least one first group of redundant connection pads arranged along said at least one array of first individual electrode connection pads, wherein the wiring substrate includes a plurality of second redundant connection pads including said at least one second common electrode connection pad, and at least one second group of redundant connection pads arranged along said at least one array of second individual electrode connection pads, and wherein the wiring substrate is provided on the outer surface of the piezoelectric actuator, such that the second individual electrode connection pads are electrically connected to said at least one of the first individual electrode connection pads, respectively, said at least one second common electrode connection pad is electrically connected to the first common electrode connection pads, and the redundant connection pads of said at least one second group are connected to the redundant connection pads of said at least one first group, respectively.

* * * * *